US007926593B2

(12) United States Patent
Bailey et al.

(10) Patent No.: US 7,926,593 B2
(45) Date of Patent: Apr. 19, 2011

(54) ROTATING CONTROL DEVICE DOCKING STATION

(75) Inventors: Thomas F. Bailey, Houston, TX (US); Don M. Hannegan, Fort Smith, AR (US); James W. Chambers, Hackett, AR (US); Danny W. Wagoner, Cypress, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 547 days.

(21) Appl. No.: 12/080,170

(22) Filed: Mar. 31, 2008

(65) Prior Publication Data

US 2008/0210471 A1 Sep. 4, 2008

Related U.S. Application Data

(63) Continuation-in-part of application No. 10/995,980, filed on Nov. 23, 2004, now Pat. No. 7,487,837, application No. 12/080,170, which is a continuation-in-part of application No. 11/366,078, filed on Mar. 2, 2006, now Pat. No. 7,836,946, which is a continuation-in-part of application No. 10/995,980.

(60) Provisional application No. 60/921,565, filed on Apr. 30, 2007.

(51) Int. Cl.
*E21B 41/04* (2006.01)

(52) U.S. Cl. ..... 175/87; 166/338; 285/920

(58) Field of Classification Search ..... 175/87; 166/338, 339, 368; 285/920
See application file for complete search history.

(56) References Cited

U.S. PATENT DOCUMENTS

| | | | |
|---|---|---|---|
| 517,509 | A | 4/1894 | Williams |
| 1,157,644 | A | 10/1915 | London |
| 1,472,952 | A | 11/1923 | Anderson |
| 1,503,476 | A | 8/1924 | Childs et al. |
| 1,528,560 | A | 3/1925 | Myers et al. |
| 1,546,467 | A | 7/1925 | Bennett |
| 1,560,763 | A | 11/1925 | Collins |
| 1,700,894 | A | 2/1929 | Joyce et al. |
| 1,708,316 | A | 4/1929 | MacClatchie |
| 1,769,921 | A | 7/1930 | Hansen |
| 1,776,797 | A | 9/1930 | Sheldon |
| 1,813,402 | A | 7/1931 | Hewitt |
| 2,038,140 | A | 7/1931 | Stone |

(Continued)

FOREIGN PATENT DOCUMENTS

CA 2363132 A1 9/2000

(Continued)

OTHER PUBLICATIONS

PCT/GB2008/050239 (corresponding to the present application US2008/0210471 A1) Annex to Form PCT/ISA/206 Communication Relating to the Results of the Partial International Search dated Aug. 26, 2008 (4 pages).

(Continued)

*Primary Examiner* — Daniel P Stephenson
(74) *Attorney, Agent, or Firm* — Strasburger & Price, LLP

(57) ABSTRACT

A system and method is provided for converting a drilling rig between conventional hydrostatic pressure drilling and managed pressure drilling or underbalanced drilling using a docking station housing mounted on a marine riser or bell nipple. This docking station housing may be positioned above the surface of the water. When a removable rotating control device is remotely hydraulically latched with the docking station housing, the system and method allows for interactive lubrication and cooling of the rotating control device, as needed, along with a supply of fluid for use with active seals.

41 Claims, 18 Drawing Sheets

U.S. PATENT DOCUMENTS

| | | | |
|---|---|---|---|
| 1,831,956 | A | 11/1931 | Harrington |
| 1,836,470 | A | 12/1931 | Humason et al. |
| 1,902,906 | A | 3/1933 | Seamark |
| 1,942,366 | A | 1/1934 | Seamark |
| 2,036,537 | A | 4/1936 | Otis |
| 2,071,197 | A | 2/1937 | Burns et al. |
| 2,124,015 | A | 7/1938 | Stone et al. |
| 2,126,007 | A | 8/1938 | Guiberson et al. |
| 2,144,682 | A | 1/1939 | MacClatchie |
| 2,148,844 | A | 2/1939 | Stone et al. |
| 2,163,813 | A | 6/1939 | Stone et al. |
| 2,165,410 | A | 7/1939 | Penick et al. |
| 2,170,915 | A | 8/1939 | Schweitzer |
| 2,170,916 | A | 8/1939 | Schweitzer et al. |
| 2,175,648 | A | 10/1939 | Roach |
| 2,176,355 | A | 10/1939 | Otis |
| 2,185,822 | A | 1/1940 | Young |
| 2,199,735 | A | 5/1940 | Beckman |
| 2,211,122 | A | 8/1940 | Howard |
| 2,222,082 | A | 11/1940 | Leman et al. |
| 2,233,041 | A | 2/1941 | Alley |
| 2,243,340 | A | 5/1941 | Hild |
| 2,243,439 | A | 5/1941 | Pranger et al. |
| 2,287,205 | A | 6/1942 | Stone |
| 2,303,090 | A | 11/1942 | Pranger et al. |
| 2,313,169 | A | 3/1943 | Penick et al. |
| 2,325,556 | A | 7/1943 | Taylor, Jr. et al. |
| 2,338,093 | A | 1/1944 | Caldwell |
| 2,480,955 | A | 9/1949 | Penick |
| 2,506,538 | A | 5/1950 | Bennett |
| 2,529,744 | A | 11/1950 | Schweitzer |
| 2,609,836 | A | 9/1952 | Knox |
| 2,628,852 | A | 2/1953 | Voytech |
| 2,646,999 | A | 7/1953 | Barske |
| 2,649,318 | A | 8/1953 | Skillman |
| 2,731,281 | A | 1/1956 | Knox |
| 2,746,781 | A | 5/1956 | Jones |
| 2,760,750 | A | 8/1956 | Schweitzer et al. |
| 2,760,795 | A | 8/1956 | Vertson |
| 2,764,999 | A | 10/1956 | Stanbury |
| 2,808,229 | A | 10/1957 | Bauer et al. |
| 2,808,230 | A | 10/1957 | McNeil et al. |
| 2,846,178 | A | 8/1958 | Minor |
| 2,846,247 | A | 8/1958 | Davis |
| 2,853,274 | A | 9/1958 | Collins |
| 2,862,735 | A | 12/1958 | Knox |
| 2,886,350 | A | 5/1959 | Horne |
| 2,904,357 | A | 9/1959 | Knox |
| 2,927,774 | A | 3/1960 | Ormsby |
| 2,929,610 | A | 3/1960 | Stratton |
| 2,962,096 | A | 11/1960 | Knox |
| 2,995,196 | A | 8/1961 | Gibson et al. |
| 3,023,012 | A | 2/1962 | Wilde |
| 3,029,083 | A | 4/1962 | Wilde |
| 3,032,125 | A | 5/1962 | Hiser et al. |
| 3,033,011 | A | 5/1962 | Garrett |
| 3,052,300 | A | 9/1962 | Hampton |
| 3,096,999 | A | 7/1963 | Ahlstone et al. |
| 3,100,015 | A | 8/1963 | Regan |
| 3,128,614 | A | 4/1964 | Auer |
| 3,134,613 | A | 5/1964 | Regan |
| 3,176,996 | A | 4/1965 | Barnett |
| 3,203,358 | A | 8/1965 | Regan et al. |
| 3,209,829 | A | 10/1965 | Haeber |
| 3,216,731 | A | 11/1965 | Dollison |
| 3,225,831 | A | 12/1965 | Knox |
| 3,259,198 | A | 7/1966 | Montgomery et al. |
| 3,268,233 | A | 8/1966 | Brown |
| 3,285,352 | A | 11/1966 | Hunter |
| 3,288,472 | A | 11/1966 | Watkins |
| 3,289,761 | A | 12/1966 | Smith et al. |
| 3,294,112 | A | 12/1966 | Watkins |
| 3,302,048 | A | 1/1967 | Gray |
| 3,313,345 | A | 4/1967 | Fischer |
| 3,313,358 | A | 4/1967 | Postlewaite et al. |
| 3,323,773 | A | 6/1967 | Walker |
| 3,333,870 | A | 8/1967 | Watkins |
| 3,347,567 | A | 10/1967 | Watkins |
| 3,360,048 | A | 12/1967 | Watkins |
| 3,372,761 | A | 3/1968 | van Gils |
| 3,387,851 | A | 6/1968 | Cugini |
| 3,397,928 | A | 8/1968 | Galle |
| 3,400,938 | A | 9/1968 | Williams |
| 3,401,600 | A | 9/1968 | Wood |
| 3,405,763 | A | 10/1968 | Pitts et al. |
| 3,421,580 | A | 1/1969 | Fowler et al. |
| 3,443,643 | A | 5/1969 | Jones |
| 3,445,126 | A | 5/1969 | Watkins |
| 3,452,815 | A | 7/1969 | Watkins |
| 3,472,518 | A | 10/1969 | Harlan |
| 3,476,195 | A | 11/1969 | Galle |
| 3,481,610 | A | 12/1969 | Slator et al. |
| 3,485,051 | A | 12/1969 | Watkins |
| 3,492,007 | A | 1/1970 | Jones |
| 3,493,043 | A | 2/1970 | Watkins |
| 3,503,460 | A | 3/1970 | Gadbois |
| 3,522,709 | A | 8/1970 | Vilain |
| 3,529,835 | A | 9/1970 | Lewis |
| 3,561,723 | A | 2/1971 | Cugini |
| 3,583,480 | A | 6/1971 | Regan |
| 3,587,734 | A | 6/1971 | Shaffer |
| 3,603,409 | A | 9/1971 | Watkins |
| 3,621,912 | A | 11/1971 | Wooddy, Jr. |
| 3,631,834 | A | 1/1972 | Gardner et al. |
| 3,638,721 | A | 2/1972 | Harrison |
| 3,638,742 | A | 2/1972 | Wallace |
| 3,653,350 | A | 4/1972 | Koons et al. |
| 3,661,409 | A | 5/1972 | Brown et al. |
| 3,664,376 | A | 5/1972 | Watkins |
| 3,667,721 | A | 6/1972 | Vujasinovic |
| 3,677,353 | A | 7/1972 | Baker |
| 3,724,862 | A | 4/1973 | Biffle |
| 3,741,296 | A | 6/1973 | Murman et al. |
| 3,779,313 | A | 12/1973 | Regan |
| 3,815,673 | A | 6/1974 | Bruce et al. |
| 3,827,511 | A | 8/1974 | Jones |
| 3,847,215 | A | 11/1974 | Herd |
| 3,868,832 | A | 3/1975 | Biffle |
| 3,872,717 | A | 3/1975 | Fox |
| 3,924,678 | A | 12/1975 | Ahlstone |
| 3,934,887 | A | 1/1976 | Biffle |
| 3,952,526 | A | 4/1976 | Watkins et al. |
| 3,955,622 | A | 5/1976 | Jones |
| 3,965,987 | A | 6/1976 | Biffle |
| 3,976,148 | A | 8/1976 | Maus et al. |
| 3,984,990 | A | 10/1976 | Jones |
| 3,992,889 | A | 11/1976 | Watkins et al. |
| 3,999,766 | A | 12/1976 | Barton |
| 4,037,890 | A | 7/1977 | Kurita et al. |
| 4,046,191 | A | 9/1977 | Neath |
| 4,052,703 | A | 10/1977 | Collins, Sr. et al. |
| 4,053,023 | A | 10/1977 | Herd et al. |
| 4,063,602 | A | 12/1977 | Howell et al. |
| 4,087,097 | A | 5/1978 | Bossens et al. |
| 4,091,881 | A | 5/1978 | Maus |
| 4,098,341 | A | 7/1978 | Lewis |
| 4,099,583 | A | 7/1978 | Maus |
| 4,109,712 | A | 8/1978 | Regan |
| 4,143,880 | A | 3/1979 | Bunting et al. |
| 4,143,881 | A | 3/1979 | Bunting |
| 4,149,603 | A | 4/1979 | Arnold |
| 4,154,448 | A | 5/1979 | Biffle |
| 4,157,186 | A | 6/1979 | Murray et al. |
| 4,183,562 | A | 1/1980 | Watkins et al. |
| 4,200,312 | A | 4/1980 | Watkins |
| 4,208,056 | A | 6/1980 | Biffle |
| 4,216,835 | A | 8/1980 | Nelson |
| 4,222,590 | A | 9/1980 | Regan |
| 4,249,600 | A | 2/1981 | Bailey |
| 4,281,724 | A | 8/1981 | Garrett |
| 4,282,939 | A | 8/1981 | Maus et al. |
| 4,285,406 | A | 8/1981 | Garrett et al. |
| 4,291,772 | A | 9/1981 | Beynet |
| 4,293,047 | A | 10/1981 | Young |
| 4,304,310 | A | 12/1981 | Garrett |
| 4,310,058 | A | 1/1982 | Bourgoyne, Jr. |
| 4,312,404 | A | 1/1982 | Morrow |

4,313,054 A 1/1982 Martini
4,326,584 A 4/1982 Watkins
4,335,791 A 6/1982 Evans
4,336,840 A 6/1982 Bailey
4,337,653 A 7/1982 Chauffe
4,345,769 A 8/1982 Johnston
4,349,204 A 9/1982 Malone
4,353,420 A 10/1982 Miller
4,355,784 A 10/1982 Cain
4,361,185 A 11/1982 Biffle
4,363,357 A 12/1982 Hunter
4,367,795 A 1/1983 Biffle
4,378,849 A 4/1983 Wilks
4,383,577 A 5/1983 Pruitt
4,384,724 A 5/1983 Derman
4,386,667 A 6/1983 Millsapps, Jr.
4,387,771 A 6/1983 Jones
4,398,599 A 8/1983 Murray
4,406,333 A 9/1983 Adams
4,407,375 A 10/1983 Nakamura
4,413,653 A 11/1983 Carter, Jr.
4,416,340 A 11/1983 Bailey
4,423,776 A 1/1984 Wagoner et al.
4,424,861 A 1/1984 Carter, Jr. et al.
4,427,072 A 1/1984 Lawson
4,439,068 A 3/1984 Pokladnik
4,440,232 A 4/1984 LeMoine
4,441,551 A 4/1984 Biffle
4,444,250 A 4/1984 Keithahn et al.
4,444,401 A 4/1984 Roche et al.
4,448,255 A 5/1984 Shaffer et al.
4,456,062 A 6/1984 Roche et al.
4,456,063 A 6/1984 Roche
4,457,489 A 7/1984 Gilmore
4,478,287 A 10/1984 Hynes et al.
4,480,703 A 11/1984 Garrett
4,484,753 A 11/1984 Kalsi
4,486,025 A 12/1984 Johnston
4,497,592 A 2/1985 Lawson
4,500,094 A 2/1985 Biffle
4,502,534 A 3/1985 Roche et al.
4,509,405 A 4/1985 Bates
4,524,832 A 6/1985 Roche et al.
4,526,243 A 7/1985 Young
4,527,632 A 7/1985 Chaudot
4,529,210 A 7/1985 Biffle
4,531,580 A 7/1985 Jones
4,531,591 A 7/1985 Johnston
4,531,593 A 7/1985 Elliott et al.
4,531,951 A 7/1985 Burt et al.
4,533,003 A 8/1985 Bailey et al.
4,540,053 A 9/1985 Baugh et al.
4,546,828 A 10/1985 Roche
4,553,591 A 11/1985 Mitchell
D282,073 S 1/1986 Bearden et al.
4,566,494 A 1/1986 Roche
4,575,426 A 3/1986 Littlejohn et al.
4,595,343 A 6/1986 Thompson et al.
4,597,447 A 7/1986 Roche et al.
4,597,448 A 7/1986 Baugh
4,610,319 A 9/1986 Kalsi
4,611,661 A 9/1986 Hed et al.
4,615,544 A 10/1986 Baugh
4,618,314 A 10/1986 Hailey
4,621,655 A 11/1986 Roche
4,623,020 A 11/1986 Nichols
4,626,135 A 12/1986 Roche
4,630,680 A 12/1986 Elkins
4,632,188 A 12/1986 Schuh et al.
4,646,826 A 3/1987 Bailey et al.
4,646,844 A 3/1987 Roche et al.
4,651,830 A 3/1987 Crotwell
4,660,863 A 4/1987 Bailey et al.
4,688,633 A 8/1987 Barkley
4,690,220 A 9/1987 Braddick
4,697,484 A 10/1987 Klee et al.
4,709,900 A 12/1987 Dyhr
4,712,620 A 12/1987 Lim et al.
4,719,937 A 1/1988 Roche et al.
4,722,615 A 2/1988 Bailey et al.
4,727,942 A 3/1988 Galle et al.
4,736,799 A 4/1988 Ahlstone
4,745,970 A 5/1988 Bearden et al.
4,749,035 A 6/1988 Cassity
4,754,820 A 7/1988 Watts et al.
4,757,584 A 7/1988 Pav et al.
4,759,413 A 7/1988 Bailey et al.
4,765,404 A 8/1988 Bailey et al.
4,783,084 A 11/1988 Biffle
4,807,705 A 2/1989 Henderson et al.
4,813,495 A 3/1989 Leach
4,817,724 A 4/1989 Funderburg, Jr. et al.
4,822,212 A 4/1989 Hall et al.
4,825,938 A 5/1989 Davis
4,828,024 A 5/1989 Roche
4,832,126 A 5/1989 Roche
4,836,289 A 6/1989 Young
4,865,137 A 9/1989 Bailey et al.
4,882,830 A 11/1989 Cartensen
4,909,327 A 3/1990 Roche
4,949,796 A 8/1990 Williams
4,955,436 A 9/1990 Johnston
4,955,949 A 9/1990 Bailey et al.
4,962,819 A 10/1990 Bailey et al.
4,971,148 A 11/1990 Roche et al.
4,984,636 A 1/1991 Bailey et al.
4,995,464 A 2/1991 Watkins et al.
5,009,265 A 4/1991 Bailey et al.
5,022,472 A 6/1991 Bailey et al.
5,028,056 A 7/1991 Bemis et al.
5,035,292 A 7/1991 Bailey et al.
5,040,600 A 8/1991 Bailey et al.
5,048,621 A 9/1991 Bailey et al.
5,062,450 A 11/1991 Bailey et al.
5,062,479 A 11/1991 Bailey et al.
5,072,795 A 12/1991 Delgado et al.
5,076,364 A 12/1991 Hale et al.
5,082,020 A 1/1992 Bailey et al.
5,085,277 A 2/1992 Hopper
5,101,897 A 4/1992 Leismer et al.
5,137,084 A 8/1992 Gonzales et al.
5,147,559 A 9/1992 Brophey et al.
5,154,231 A 10/1992 Bailey et al.
5,163,514 A 11/1992 Jennings
5,165,480 A 11/1992 Wagoner et al.
5,178,215 A 1/1993 Yenulis et al.
5,182,979 A 2/1993 Morgan
5,184,686 A 2/1993 Gonzalez
5,195,754 A 3/1993 Dietle
5,213,158 A 5/1993 Bailey et al.
5,215,151 A 6/1993 Smith et al.
5,224,557 A 7/1993 Yenulis et al.
5,230,520 A 7/1993 Dietle et al.
5,243,187 A 9/1993 Hettlage
5,251,869 A 10/1993 Mason
5,255,745 A 10/1993 Czyrek
5,277,249 A 1/1994 Yenulis et al.
5,279,365 A 1/1994 Yenulis et al.
5,305,839 A 4/1994 Kalsi et al.
5,320,325 A 6/1994 Young et al.
5,322,137 A 6/1994 Gonzales
5,325,925 A 7/1994 Smith et al.
5,348,107 A 9/1994 Bailey et al.
5,375,476 A 12/1994 Gray
5,427,179 A 6/1995 Bailey et al.
5,431,220 A 7/1995 Lennon et al.
5,443,129 A 8/1995 Bailey et al.
5,495,872 A 3/1996 Gallagher et al.
5,529,093 A 6/1996 Gallagher et al.
5,588,491 A 12/1996 Brugman et al.
5,607,019 A 3/1997 Kent
5,647,444 A 7/1997 Williams
5,657,820 A 8/1997 Bailey et al.
5,662,171 A 9/1997 Brugman et al.
5,662,181 A 9/1997 Williams et al.
5,671,812 A 9/1997 Bridges
5,678,829 A 10/1997 Kalsi et al.
5,735,502 A 4/1998 Levett et al.

5,738,358 A 4/1998 Kalsi et al.
5,755,372 A 5/1998 Cimbura
5,823,541 A 10/1998 Dietle et al.
5,829,531 A 11/1998 Hebert et al.
5,848,643 A 12/1998 Carbaugh et al.
5,873,576 A 2/1999 Dietle et al.
5,878,818 A 3/1999 Hebert et al.
5,901,964 A 5/1999 Williams et al.
5,944,111 A 8/1999 Bridges
6,007,105 A 12/1999 Dietle et al.
6,016,880 A 1/2000 Hall et al.
6,017,168 A 1/2000 Fraser, Jr. et al.
6,036,192 A 3/2000 Dietle et al.
6,076,606 A 6/2000 Bailey et al.
6,102,123 A 8/2000 Bailey et al.
6,102,673 A 8/2000 Mott et al.
6,109,348 A 8/2000 Caraway
6,109,618 A 8/2000 Dietle
6,112,810 A 9/2000 Bailey et al.
6,120,036 A 9/2000 Kalsi et al.
6,129,152 A 10/2000 Hosie et al.
6,138,774 A 10/2000 Bourgoyne, Jr. et al.
6,170,576 B1 1/2001 Brunnert et al.
6,202,745 B1 3/2001 Reimert et al.
6,209,663 B1 4/2001 Hosie
6,213,228 B1 4/2001 Saxman
6,227,547 B1 5/2001 Dietle et al.
6,230,824 B1 5/2001 Peterman et al.
6,244,359 B1 6/2001 Bridges et al.
6,263,982 B1 7/2001 Hannegan et al.
6,273,193 B1 8/2001 Hermann et al.
6,315,302 B1 11/2001 Conroy et al.
6,315,813 B1 11/2001 Morgan et al.
6,325,159 B1 12/2001 Peterman et al.
6,334,619 B1 1/2002 Dietle et al.
6,354,385 B1 3/2002 Ford et al.
6,375,895 B1 4/2002 Daemen
6,382,634 B1 5/2002 Dietle et al.
6,386,291 B1 5/2002 Short et al.
6,413,297 B1 7/2002 Morgan et al.
6,450,262 B1 9/2002 Regan
6,454,007 B1 9/2002 Bailey
6,457,529 B2 10/2002 Calder et al.
6,470,975 B1 10/2002 Bourgoyne et al.
6,478,303 B1 11/2002 Radcliffe
6,494,462 B2 12/2002 Dietle
6,504,982 B1 1/2003 Greer, IV
6,505,691 B2 1/2003 Judge et al.
6,520,253 B2 2/2003 Calder
6,536,520 B1 3/2003 Snider et al.
6,536,525 B1 3/2003 Haugen et al.
6,547,002 B1 4/2003 Bailey et al.
6,554,016 B2 4/2003 Kinder
6,561,520 B2 5/2003 Kalsi et al.
6,581,681 B1 6/2003 Zimmerman et al.
6,607,042 B2 8/2003 Hoyer et al.
RE38,249 E 9/2003 Tasson et al.
6,655,460 B2 12/2003 Bailey et al.
6,685,194 B2 2/2004 Dietle et al.
6,702,012 B2 3/2004 Bailey et al.
6,708,762 B2 3/2004 Haugen et al.
6,720,764 B2 4/2004 Relton et al.
6,725,951 B2 4/2004 Looper
6,732,804 B2 5/2004 Hosie et al.
6,749,172 B2 6/2004 Kinder
6,767,016 B2 7/2004 Gobeli et al.
6,843,313 B2 1/2005 Hult
6,851,476 B2 2/2005 Gray et al.
6,877,565 B2 4/2005 Edvardsen
6,886,631 B2 5/2005 Wilson et al.
6,896,048 B2 5/2005 Mason et al.
6,896,076 B2 5/2005 Nelson et al.
6,913,092 B2 7/2005 Bourgoyne et al.
6,945,330 B2 9/2005 Wilson et al.
7,004,444 B2 2/2006 Kinder
7,007,913 B2 3/2006 Kinder
7,011,167 B2 3/2006 Ebner et al.
7,025,130 B2 4/2006 Bailey et al.
7,028,777 B2 4/2006 Wade et al.
7,032,691 B2 4/2006 Humphreys
7,040,394 B2 5/2006 Bailey et al.
7,044,237 B2 5/2006 Leuchtenberg
7,073,580 B2 7/2006 Wilson et al.
7,077,212 B2 7/2006 Roesner et al.
7,080,685 B2 7/2006 Bailey et al.
7,086,481 B2 8/2006 Hosie et al.
7,152,680 B2 12/2006 Wilson et al.
7,159,669 B2 1/2007 Bourgoyne et al.
7,165,610 B2 1/2007 Hopper
7,174,956 B2 2/2007 Williams et al.
7,178,600 B2 2/2007 Luke et al.
7,191,840 B2 3/2007 Pietras et al.
7,198,098 B2 4/2007 Williams
7,204,315 B2 4/2007 Pia
7,219,729 B2 5/2007 Bostick et al.
7,237,618 B2 7/2007 Williams
7,237,623 B2 7/2007 Hannegan
7,240,727 B2 7/2007 Williams
7,243,958 B2 7/2007 Williams
7,255,173 B2 8/2007 Hosie et al.
7,258,171 B2 8/2007 Bourgoyne et al.
7,278,494 B2 10/2007 Williams
7,278,496 B2 10/2007 Leuchtenberg
7,296,628 B2 11/2007 Robichaux et al.
7,308,954 B2 12/2007 Martin-Marshall
7,325,610 B2 2/2008 Giroux et al.
7,334,633 B2 2/2008 Williams et al.
7,347,261 B2 3/2008 Markel et al.
7,350,590 B2 4/2008 Hosie et al.
7,363,860 B2 4/2008 Wilson et al.
7,367,411 B2 5/2008 Leuchtenberg
7,380,590 B2 6/2008 Hughes
7,380,591 B2 6/2008 Williams
7,380,610 B2 6/2008 Williams
7,383,876 B2 6/2008 Gray et al.
7,389,183 B2 6/2008 Gray
7,392,860 B2 7/2008 Johnston
7,413,018 B2 8/2008 Hosie et al.
7,416,021 B2 8/2008 Williams
7,416,226 B2 8/2008 Williams
7,448,454 B2 11/2008 Bourgoyne et al.
7,451,809 B2 11/2008 Noske et al.
7,475,732 B2 1/2009 Hosie et al.
7,487,837 B2 2/2009 Bailey et al.
7,513,300 B2 4/2009 Pietras et al.
7,559,359 B2 7/2009 Williams
7,635,034 B2 12/2009 Williams
7,654,325 B2 2/2010 Giroux et al.
7,669,649 B2 3/2010 Williams
7,699,109 B2 4/2010 May et al.
2003/0164276 A1 9/2003 Snider et al.
2003/0173073 A1 9/2003 Snider et al.
2004/0017190 A1 1/2004 McDearmon et al.
2005/0028972 A1 2/2005 Wilson et al.
2005/0151107 A1 7/2005 Shu
2005/0211429 A1 9/2005 Gray et al.
2005/0241833 A1 11/2005 Bailey et al.
2006/0037782 A1 2/2006 Martin-Marshall
2006/0108119 A1 5/2006 Bailey et al.
2006/0144622 A1 7/2006 Bailey et al.
2006/0157282 A1 7/2006 Tilton et al.
2006/0191716 A1 8/2006 Humphreys
2007/0051512 A1 3/2007 Markel et al.
2007/0095540 A1 5/2007 Kozicz et al.
2007/0163784 A1 7/2007 Bailey et al.
2008/0035377 A1 2/2008 Sullivan et al.
2008/0041149 A1 2/2008 Leuchtenberg
2008/0047449 A1 2/2008 Wilson et al.
2008/0059073 A1 3/2008 Giroux et al.
2008/0060846 A1 3/2008 Belcher et al.
2008/0105462 A1 5/2008 May et al.
2008/0110637 A1 5/2008 Snider et al.
2008/0169107 A1 7/2008 Redlinger et al.
2008/0210471 A1 9/2008 Bailey et al.
2008/0236819 A1 10/2008 Foster et al.
2008/0245531 A1 10/2008 Noske et al.
2008/0296016 A1 12/2008 Hughes et al.
2009/0025930 A1 1/2009 Iblings et al.

| | | | |
|---|---|---|---|
| 2009/0057012 | A1 | 3/2009 | Williams |
| 2009/0057020 | A1 | 3/2009 | Williams |
| 2009/0057021 | A1 | 3/2009 | Williams |
| 2009/0057022 | A1 | 3/2009 | Williams |
| 2009/0057024 | A1 | 3/2009 | Williams |
| 2009/0057025 | A1 | 3/2009 | Williams |
| 2009/0057027 | A1 | 3/2009 | Williams |
| 2009/0057029 | A1 | 3/2009 | Wiilams |
| 2009/0101351 | A1 | 4/2009 | Hannegan et al. |
| 2009/0101411 | A1 | 4/2009 | Hannegan et al. |
| 2009/0139724 | A1 | 6/2009 | Gray et al. |
| 2009/0152006 | A1 | 6/2009 | Leduc et al. |
| 2009/0166046 | A1 | 7/2009 | Edvardsen et al. |
| 2009/0200747 | A1 | 8/2009 | Williams |
| 2009/0211239 | A1 | 8/2009 | Askeland |
| 2009/0236144 | A1 | 9/2009 | Todd et al. |
| 2009/0301723 | A1 | 12/2009 | Gray |
| 2010/0008190 | A1 | 1/2010 | Gray et al. |

FOREIGN PATENT DOCUMENTS

| | | | |
|---|---|---|---|
| CA | 2447196 | A1 | 4/2004 |
| EP | 0290250 | A2 | 11/1988 |
| EP | 0290250 | A3 | 11/1988 |
| EP | 0267140 | B1 | 3/1993 |
| EP | 1375817 | A1 | 1/2004 |
| EP | 1519003 | A1 | 3/2005 |
| EP | 1659260 | A2 | 5/2006 |
| GB | 2019921 | A | 11/1979 |
| GB | 2067235 | A | 7/1981 |
| GB | 2394741 | A | 5/2004 |
| GB | 2449010 | A | 8/2007 |
| WO | WO 99/45228 | A1 | 9/1999 |
| WO | WO 99/50524 | A2 | 10/1999 |
| WO | WO 99/50524 | A3 | 10/1999 |
| WO | WO 99/51852 | A1 | 10/1999 |
| WO | WO 00/52299 | A1 | 9/2000 |
| WO | WO 00/52300 | A1 | 9/2000 |
| WO | WO 02/50398 | A1 | 6/2002 |
| WO | WO 03/071091 | A1 | 8/2003 |
| WO | WO 2006/088379 | A1 | 8/2006 |
| WO | WO 2007/092956 | A2 | 8/2007 |
| WO | WO 2008/133523 | A1 | 11/2008 |
| WO | WO 2008/156376 | A1 | 12/2008 |
| WO | WO 2009/017418 | A1 | 2/2009 |

OTHER PUBLICATIONS

PCT/GB2008/050239 (corresponding to the present application US2008/0210471 A1) International Search Report and Written Opinion of the International Searching Authority dated Oct. 20, 2008 (19 pages).

Second Substantive Examination Report from the European Patent Office, Application No. 08 719 084.9-2315 (corresponding to the present application US2008/0210471 A1) dated May 6, 2010 (4 pages).

Response to 70 above, European Patent Application No. 08719084.9 (corresponding to the present application US2008/0210471 A1) dated Nov. 16, 2010 (4 pages).

US 6,708,780 B2, Bourgoyne, et al. (withdrawn).

Cameron, The Modular T BOP Stack System, Brochure SD-100076, Apr. 1985 © 1985 Cameron Iron Works, Inc. (5 pages).

Cameron, Cameron HC Collet Connector, Brochure WR4701, Mar. 1996 © 1996 Cooper Cameron Corporation, Cameron Division (12 pages).

Gault, Allen, Riserless drilling: circumventing the size/cost cycle in deepwater—Conoco, Hydril project seek enabling technologies to drill in deepest water depths economically, Offshore Drilling Technology, May 1996, pp. 49, 50, 52, 53, 54 & 55 (6 pages).

Williams Tool Company, Inc. website home page, Under Construction Williams Rotating Control Heads (2 pages); Seal-Ability for the pressures of drilling (2 pages); Williams Model 7000 Series Rotating Control Heads (1 page); Williams Model 7000 & 7100 Series Rotating Control Heads (2 pages); Williams Model IP1000 Rotating Control Head (2 pages); Williams Conventional Models 8000 & 9000 (2 pages); Applications—Where using a Williams rotating control head while drilling is a plus (1 page); Williams higher pressure rotating control head systems are Ideally Suited for New Technology Flow Drilling and Closed Loop Underbalanced Drilling (UBD) Vertical and Horizontal (2 pages); and How to Contact Us (2 pages).

Furlow, William, Shallow flow diverter JIP spurred by deepwater washouts, Offshore—World Trends and Technology for Offshore Oil and Gas Operations, Mar. 1998, cover page and pp. 2 & 90 (3 pages).

Williams Tool Company, Inc., Rotating Control Heads and Strippers for Air, Gas, Mud, and Geothermal Drilling Worldwide—Sales Rental Service, © 1988 Williams Tool Co., Inc. (19 pages).

Williams Tool Company, Inc., Rotating Control Heads and Strippers for Air, Gas, Mud, Geothermal and Horizontal Drilling, Catalog #2002, © 1991 Williams Tool Co., Inc. (19 pages).

Fig. 14 Floating Piston Drilling Choke Design, printed May 1997 (1 page).

Stone, Charles R. "Rick" et al., Blowout Preventer Testing for Underbalanced Drilling, Sep. 1997, Signa Engineering Corp., Houston, Texas (24 pages).

Williams Tool Company, Inc., Instructions—Assemble & Disassemble Model 9000 Bearing Assembly (cover page and 27 numbered pages).

Williams Tool Company, Inc., Rotating Control Heads—Making Drilling Safer While Reducing Costs Since 1968, © 1989 Williams Tool Co., Inc. (4 pages).

Williams Tool Company, Inc., International—Model 7000 Rotating Control Head, © 1991 Williams Tool Co., Inc. (4 pages).

Williams Tool Company, Inc., Williams Rotating Control Heads—Reduce Costs—Increase Safety—Reduce Environmental Impact, © 1995 Williams Tool Co., Inc. (4 pages).

Williams Tool Company, Inc., Sales-Rental-Service—Williams Rotating Control Heads and Strippers for Air, Gas, Mud, and Geothermal Drilling, © 1982 Williams Tool Co., Inc. (7 pages).

Williams Tool Company, Inc., Rotating Control Heads and Strippers for Air, Gas, Mud and Geothermal Drilling, Catalog #2001, © 1991 Williams Tool Co., Inc. (19 pages).

Hannegan, Don, Williams Tool Co., Inc., Communicating—The When? And Why? of Rotating Control Head Usage, The Brief Jan. 1996 issue, The Brief's Guest Columnists, Dec. 13, 1995 Article Index No. 20, pp. 26-27, © 1996 Murphy Publishing, Inc. (2 pages).

Bourgoyne, Jr., Adam T., Rotating control head applications increasing, Oil & Gas Journal, Technology, Reprinted from the Oct. 9, 1995 edition of Oil & Gas Journal, © 1995 PennWell Publishing Company (4 pages).

Grant Oil Tool Company, Rotating Drilling Head for Air, Gas or Mud Drilling, 1966-1967 Composite Catalog, p. 2041 (1 page).

Grant Oil Tool Company, Rotating Drilling Head Models 7068, 7368, 8068 (Patented)—Equally Effective with Air, Gas, or Mud Circulation Media, 1976-1977 Composite Catalog, pp. 2691-2693 (3 pages).

Bourgoyne, Darryl A. et al., A Subsea Rotating Control Head for Riserless Drilling Applications, 1998 International Association of Drilling Contractors International Deep Water Well Control Conference held in Houston, Texas, Aug. 26-27, 1998, pp. D-86 to D-99 © 1998 (14 pages).

Hannegan, Don, Applications widening for rotating control heads, Drilling Contractor, Jul. 1996, cover page and pp. 5, 17, & 19, vol. 52, No. 4, Drilling Contractor Publications Inc., Houston, Texas (4 pages).

Hughes Tool Company, Hughes Offshore 1986-87 Subsea Systems and Equipment, Hughes Drilling Equipment Composite Catalog, pp. 2986-3004 (19 pages).

Williams Tool Company, Inc., Technical Specifications Model—The Model 7100 (3 pages).

Williams Tool Company, Inc. website, Underbalanced Drilling (UBD)—The Attraction of UBD (2 pages).

Williams Tool Company, Inc. website, Applications—Where using a Williams rotating control head while drilling is a plus (2 pages).

Williams Tool Company, Inc. website, Model 7100 (3 pages).

Hughes Tool Company, Hughes Offshore 1982/1983 Regan Products, Hughes Offshore Composite Catalog, Regan Products, cover page, 4308-20, 4308-27 thru 4308-43, and end sheet, (see p. 4308-36 Type KFDR Diverter) © 1982 Hughes Offshore (20 pages).

Coflexip International, Brochure, p. 1: Coflexip Sales Offices, p. 2: The Flexible Steel Pipe for Drilling and Service Applications, p. 3: New 5" I.D.—General Drilling Flexible, p. 4: Applications, and p. 5-Illustration (5 pages).
Baker, Ron, A Primer of Oilwell Drilling, 4th Edition, 3 cover pages and pp. 42-49, Petroleum Extension Service of The University of Texas at Austin, Austin, Texas © 1979 The University of Texas at Austin (11 pages).
Dutch Enterprises Inc., Lock down Lubricator System—"Safety with Savings", pp. D-3 thru D-18 (see above U.S. Patent No. 4,836,289 referenced on pp. D-6 & D-7)(16 pages).
Hydril Company website, Hydril GL® Annual Blowout Preventers (Patented), printed Aug. 28, 1998, pp. D-20 & D-21, corresponding website http://www.hydril.com/ns/Pbro/bop8.htm, (see Roche patents above) (2 pages).
Hydril Company website, About Pressure Control Products, printed Aug. 28, 1998, pp. D-29 thru D-47, corresponding website http://www.hydril.com/ns/Pbro/bop8.htm, (the GH Gas Handler Series Product is listed), © 1996 Hydril Company (19 pages).
NL Industries, Inc., Shaffer Type 79 Rotating Blowout Preventers—NL Rig Equipment/NL Industries, Inc., pp. D-49 thru D-54, Brochure NLS 4849-580 (6 pages).
Shaffer®, A Varco® Company, Shaffer® Pressure Control, Spherical® Blowout Preventers, Shaffer's NXT BOP, Other Products, cover page and pp. 1562-1568 (8 pages).
Leach, Colin P. et al., Avoiding Explosive Unloading of Gas in a Deep Water Riser when SOBM is in Use, 1998 (describes an application for the Hydril GH 21-2000 Gas Handler shown in Figure 1) (9 pages).
Lopes, Clovis A. et al., Feasibility Study of a Dual Density Mud System for Deepwater Drilling Operations, 1997 Offshore Technology Conference held in Houston, Texas, May 5-8, 1997, Paper No. OTC 8465; pp. 257-266 © 1997 Offshore Technology Conference (10 pages).
Offshore Drilling with Light-weight Fluids, Joint Industry Project Presentation, Apr. 1998, pp. C-3 thru C-11 (9 pages).
Nakagawa, Edson Y. et al., Application of Aerated-Fluid Drilling in Deepwater, 1999 SPE/IADC Drilling Conference held in Amsterdam, Holland, Mar. 9-11, 1999, Paper SPE/IADC 52787, Presented by Don Hannegan, P.E., SPE © 1999 SPE/IADC Drilling Conference (5 pages).
Inter-Tech Drilling Solutions Ltd., Inter-Tech Drilling Solutions Ltd.'s RBOP™ means Safety and Experience for Underbalanced Drilling, Inter-Tech Drilling Solutions Ltd./Big D Rentals & Sales (1981) Ltd. (2 pages).
Shaffer®, A Varco® Company, Pressure Control While Drilling, © Varco Shaffer, Inc. (2 pages).
Shaffer®, A Varco® Company, Field Exposure (As of Aug. 1998) (1 page).
Rotating Spherical BOP (1 page).
Nakagawa, Edson Yoshihito et al., JIP's Work Brightens Outlook for UBD in Deep Waters, The American Oil & Gas Reporter®, Apr. 1999, cover page and pp. 53, 56, 58-61 & 63 (8 pages).
Seal-Tech—Division Folsom Metal Products, 1500 PSI Rotating Blowout Preventer, (3 pages).
Techcorp Industries International, Inc., RPM System 3000™ Rotating Blowout Preventer—"Setting a new standard in Well Control," (4 pages).
Williams Tool Company, Inc., RiserCap™ Materials Presented at the 1999 LSU/MMS/IADC Well Control Workshop, Mar. 24-25, 1999, Session 2, Presentation 12 © 1999 Williams Tool Company, Inc. (14 pages).
Smith, John Rogers, The 1999 LSU/MMS Well Control Workshop: An overview, World Oil®, Jun. 1999, cover page and pp. 4, 41-42, & 44-45, Gulf Publishing Company, Houston, Texas (6 pages).
Nessa, Dag Oluf et al., Offshore underbalanced drilling system could revive field developments, World Oil®, Oct. 1997, vol. 218, No. 10, cover page and pp. 3, 83-84, 86, & 88, Gulf Publishing Company, Houston, Texas, © 1997 Gulf Publishing Company (6 pages).
Nessa, Dag Oluf et al., Offshore underbalanced drilling system could revive field developments, World Oil®, Jul. 1997, vol. 218, No. 7, cover page and pp. 3, 61-64, & 66, Gulf Publishing Company, Houston, Texas, © 1997 Gulf Publishing Company (7 pages).
PCT International Search Report, International Application No. PCT/US99/06695, completion date May 27, 1999, mailing date Jun. 14, 1999 (4 pages).
PCT International Search Report, International Application No. PCT/GB00/00731, completion date Jun. 16, 2000, mailing date Jun. 27, 2000 (3 pages).
National Academy of Sciences—National Research Council, Design of a Deep Ocean Drilling Ship, cover page and pp. 114-121 (cited in above U.S. Patent No. 6,230,824 B1) (9 pages).
Cress, L.A. et al., History and Development of a Rotating Preventer, 1992 IADC/SPE Drilling Conference held in New Orleans, Louisiana, Feb. 18-21, 1992, Paper IADC/SPE 23931, pp. 757-773 (17 pages).
Rehm, Bill, Practical Underbalanced Drilling and Workover, 2002, cover page, title page, copyright page, and pp. 6-6, 11-2, 11-3, G-9, and G-10, Petroleum Extension Service—The University of Texas at Austin, © 2002 The University of Texas at Austin (8 pages).
Williams Tool Company Inc., Risercap™: Rotating Control Head System For Floating Drilling Rig Applications, © 1999 Williams Tool Company, Inc. (4 pages).
Lage, Antonio et al., Drilling With Aerated Drilling Fluid From a Floating Unit Part 2: Drilling the Well, 2001 SPE Annual Technical Conference and Exhibition held in New Orleans, Louisiana, Sep. 30, 2001 to Oct. 3, 2001, Paper SPE 71361, © 2001 Society of Petroleum Engineers, Inc. (11 pages).
Santos, Helio et al., Drilling and Aerated Fluid from a Floating Unit. Part 1: Planning, Equipment, Tests, and Rig Modifications, 2001 SPE/IADC Drilling Conference held in Amsterdam, The Netherlands, Feb. 27, 2001 to Mar. 1, 2001, Paper SPE/IADC 67748, © 2001 SPE/IADC Drilling Conference (8 pages).
Nakagawa, E. Y. et al., Planning of Deepwater Drilling Operations with Aerated Fluids, 1999 SPE Asia Pacific Oil and Gas Conference and Exhibition held in Jakarta, Indonesia, Apr. 20-22, 1999, Paper SPE 54283, (© 1999 Society of Petroleum Engineers (7 pages).
Nakagawa, E. Y. et al., Implementing the Light-Weight Fluids Drilling Technology in Deepwater Scenarios, 1999 LSU/MMS Well Control Workshop Mar. 24-25, 1999 (12 pages).
Stewart & Stevenson website, Press Releases: Stewart & Stevenson introduces First Dual Gradient Riser, Aug. 31, 2000, printed Oct. 7, 2002, corresponding website http://www.ssss.com/ssss/20000831.asp (2 pages).
Williams Tool Company Inc., Williams Tool Company Introduces the . . . Virtual Riser™, © 1998 Williams Tool Company, Inc. (4 pages).
The University of Texas at Austin website, Petroleum Extension Service, PETEX Publications, printed Nov. 14, 2003, corresponding website http://www.utexas.edu/cee/petex/pubs/drilling.html, (last modified Dec. 6, 2002) (12 pages).
SPE International, BG in the Caspian region, SPE Review, Magazine of the Aberdeen and London Sections of the Society of Petroleum Engineers, May 2003, Issue 164 (3 pages).
Impact Fluid Solutions, Field Cases as of Mar. 3, 2003, printed Sep. 5, 2003, corresponding website http://www.impact-os.com/fluid_solutions/Field_Cases.htm (6 pages).
Maurer Technology Inc, Determine in the Safe Application of Underbalanced Drilling Technologies in Marine Environments—Technical Proposal, Jun. 17, 2002, Proposal TP02-10 JIP (13 pages).
Colbert, John W., John W. Colbert, P.E. Vice President Engineering Biographical Data, Signa Engineering Corp. (2 pages).
Parker Drilling website, Technical Training Courses, printed Sep. 5, 2003, corresponding website http://www.parkerdrilling.com/news/tech.html (5 pages).
Drilling equipment: Improvements from data recording to slim hole, Drilling Contractor, Mar./Apr. 2000, pp. 30-32, Drilling Contractor Publications, Inc., Houston, Texas (3 pages).
Drilling conference promises to be informative, Drilling Contractor, Jan./Feb. 2002, p. 10 (1 page).
OGCI, Inc. website, Underbalanced and Air Drilling, printed Sep. 5, 2003, corresponding website http://www.ogci.com/course_info.asp?counselD=410 (2 pages).
Society of Professional Engineers website, 2003 SPE Calendar, printed Sep. 5, 2003, cache of corresponding website http://www.

spe.org/spe/cda/views/events/eventMaster/0,1470,1648_2194_632303.00.html, © 2001 Society of Professional Engineers (2 pages).
Schlumberger Limited website, Oilfield Glossary—reverse-circulating valve, corresponding website http://www.glossary.oilfield.slb.com/Display.cfm?Term=reverse-circulating%20valve, © 2003 Schlumberger Limited (1 page).
Murphy, Ross D. et al., A drilling contractor's view of underbalanced drilling, WorldOil® Magazine, May 2002, vol. 223, No. 5, Feature Article (9 pages).
Weatherford, Weatherford UnderBalanced Services—General Underbalance Presentation to the DTI, © 2002 Weatherford (71 pages).
Rach, Nina M., Underbalanced near-balanced drilling are possible offshore, Oil & Gas Journal, Dec. 1, 2003, pp. 39-44 (6 pages).
Forrest, Neil et al., Subsea Equipment for Deep Water Drilling Using Dual Gradient Mud System, SPE/IADC Drilling Conference held in Amsterdam, The Netherlands, Feb. 27, 2001 to Mar. 1, 2001, Paper SPE/IADC 67707, © 2001 SPE/IADC Drilling Conference (8 pages).
Hannegan, D.M. et al., Deepwater Drilling with Lightweight Fluids—Essential Equipment Required, SPE/IADC Drilling Conference held in Amsterdam, The Netherlands, Feb. 27, 2001 to Mar. 1, 2001, Paper SPE/IADC 67708, © 2001 SPE/IADC Drilling Conference (6 pages).
Hannegan, Don M., Underbalanced Operations Continue Offshore Movement, SPE/IcoTA Coiled Tubing Roundtable held in Houston, Texas, Mar. 7-8, 2001, Paper SPE 68491, © 2001 Society of Petroleum Engineers, Inc. (3 pages).
Hannegan, D., Underbalanced Drilling—Perceptions and Realities of Today's Technology in Offshore Applications, IADC/SPE Drilling Conference held in Dallas, Texas, Feb. 26-28, 2002, Paper IADC/SPE 74448, © 2002 IADC/SPE Drilling Conference (9 pages).
Hannegan, Don M. et al., Well Control Considerations—Offshore Applications of Underbalanced Drilling Technology, SPE/IADC Drilling Conference held in Amsterdam, The Netherlands, Feb. 19-21, 2003, Paper SPE/IADC 79854, © 2003 SPE/IADC Drilling Conference (14 pages).
Bybee, Karen, Offshore Applications of Underbalanced—Drilling Technology, Journal of Petroleum Technology, Jan. 2004, cover page and pp. 51-52 (3 pages).
Bourgoyne, Darryl A. et al., A Subsea Rotating Control Head for Riserless Drilling Applications, 1998 IADC International Deep Water Well Control Conference held in Houston, Texas, Aug. 26-27, 1998 (see document T) © 1998 (14 pages).
Lage, Antonio et al., Drilling With Aerated Drilling Fluid From a Floating Unit Part 2: Drilling the Well, 2001 SPE Annual Technical Conference and Exhibition held in New Orleans, Louisiana, Sep. 30, 2001 to Oct. 3, 2001, Paper SPE 71361, (see document BBB) © Society of Professional Engineers Inc. (11 pages).
Furlow, William, Shell's seafloor pump, solids removal key to ultra-deep, dual-gradient drilling—Skid ready for commercialization, Offshore Magazine, World Trends and Technology for Offshore Oil and Gas Operations, Jun. 2001, cover page, and pp. 4, 54, 2 unnumbered pages, & 106, International Edition, vol. 61, No. 6, PennWell, © 2001 PennWell (6 pages).
Rowden, Michael V., Advances in riserless drilling pushing the deepwater surface string envelope—Alternative to seawater, CaCl2 sweeps, Offshore Magazine, World Trends and Technology for Offshore Oil and Gas Operations, Jun. 2001, cover page, pages 4, 56, 58, and 106, International Edition, vol. 61, No. 6, PennWell, © 2001 PennWell (5 pages).
Boye, John, Multi Purpose Intervention Vessel Presentation, M.O.S.T. Multi Operational Service Tankers, Jan. 2004, © 2003 Weatherford (43 pages).
GB Search Report, International Application No. GB 0324939.8, Jan. 21, 2004 (1 page).
Terwogt, Jan; Maekiaho, Leo; Si-Boon, Wee (Shell Malaysia Exploration and Production); Jenkins, James; Gedge, Ben (Weatherford); "Pressured Mud Cap Drilling—Advanced Well Control for Subsea Wells"; Petromin Subsea Asia Conference, Sep. 20-21, 2004, Kuala Lumpur, Malaysia (8 pages).
PCT International Search Report, International Application No. PCT/EP2004/052167, date of completion Nov. 25, 2004, date of mailing Dec. 2, 2004 (4 pages).
PCT Written Opinion of the International Searching Authority, International Application No. PCT/EP2004/052167 (6 pages).
Supplementary European Search Report, Application No. EP 99908371, date of completion Oct. 22, 2004 (3 pages).
Vetco Offshore Industries, Inc., General Catalog 1970-1971, Vetcor® Subsea Systems, cover page, and pp. 4799-4800, 4816-4818 (see numbered p. 4816 for "patented" Vetco H-4 connectors) (6 pages).
Vetco Offshore, Inc., General Catalog 1972-1973, Subsea Systems, cover page, company page and pp. 4498, 4509-4510 (5 pages).
Vetco Offshore, Inc., General Catalog 1974-1975, cover page, company page and pp. 5160, 5178-5179 (5 pages).
Vetco Offshore, Inc., General Catalog 1976-1977, Subsea Drilling and Completion Systems, cover page and pp. 5862-5863, and 5885 (4 pages).
Vetco, General Catalog 1982-1983, cover page and pp. 8454-8455, 8479 (4 pages).
Shaffer, A Varco Company website, Pressure Control While Drilling System, printed Jun. 21, 2004, corresponding website http://www.tulsaequip.com (2 pages).
Precision Drilling Corporation, Performance Drilling by Precision Drilling. A Smart Equation, (see 9th page for "Northland's patented RBOP . . . "), © 2002 Precision Drilling Corporation (12 pages).
Weatherford, RPM System 3000™ Rotating Blowout Preventer—Setting a new standard in Well Control, Weatherford Underbalanced Systems, Brochure #333.01 © 2002-2005 Weatherford (4 pages).
Hannegan, Don, Managed Pressure Drilling in Marine Environments, Drilling Engineering Association Workshop, Moody Gardens, Galveston, Texas, Jun. 22-23, 2004, © 2004 Weatherford (28 pages).
Smith International, Inc., Hold™ 2500 RCD Rotating Control Device web page and brochure, printed Oct. 27, 2004, corresponding website http://www.smith.com/hold2500, Smith Services, A Business Unit of Smith International, Inc. © 2004 Smith International, Inc. (5 pages).
Rehm, Bill, Practical Underbalanced Drilling and Workover, 2002, cover page, title page, copyright page, and pp. 6-1 to 6-9, and 7-1 to 7-9, Petroleum Extension Service—The University of Texas at Austin, © 2002 The University of Texas at Austin (21 pages).
Terwogt, J.H. et al., Pressured Mud Cap Drilling from A Semi-Submersible Drilling Rig, SPE/IADC Drilling Conference held in Amsterdam, The Netherlands, Feb. 23-25, 2005, Paper SPE/IADC 92294, © 2005 SPE/IADC Drilling Conference (6 pages).
Tangedahl, M.J., et al., Rotating Preventers: Technology for better well control, World Oil, Oct. 1992, pp. 63-64 & 66, vol. 213, No. 10, Gulf Publishing Company, Houston, Texas (3 pages).
Partial European Search Report, Application No. EP 05 27 0083, completed Feb. 8, 2006 (5 pages).
Netherlands Search Report, Application No. NL 1026044, date completed Dec. 14, 2005 (3 pages).
International Search Report, Application No. PCT/GB 00/00731 (corresponding to U.S. 6,470,975), completed Jun. 16, 2000 (2 pages).
GB Examination Report, Application No. GB0324939.8 (corresponding to U.S. 6,470,975), Mar. 21, 2006 (6 pages).
GB Examination Report, Application No. GB0324939.8 (corresponding to U.S. 6,470,975), Jan. 22, 2004 (3 pages).
MicroPatent® Family Lookup, U.S. Pub. No. 2003/0106712, printed Jun. 15, 2006 (5 pages).
MicroPatent® Family Lookup, U.S. 6,470,975, printed Jun. 15, 2006 (5 pages).
AU Examination Report, Application No. 28183/00 (corresponding to U.S. 6,470,975), Sep. 9, 2002 (1 page).
NO Examination Report, Application No. 20013953 (corresponding to U.S. Patent No. 6,470,975), first page English translation, Apr. 29, 2003 (3 pages).
Nessa, Dag Oluf et al., Offshore underbalanced drilling system could revive field developments, World Oil®, Jul. 1997, vol. 218, No. 7, cover page and pp. 3, 61-64 and 66 (Part 1), and World Oil®, Oct. 1997, vol. 218, No. 10, cover page and pp. 3, 83-84, 86 and 88 (Part 2) (see 5A, 5G above and 5I below), Gulf Publishing Company, Houston, Texas, © 1997 Gulf Publishing Company (13 pages).
International Search Report, Application No. PCT/GB 00/00731 (corresponding to U.S. 6,470,975), completed Jun. 16, 2000 (4 pages).
International Preliminary Examination Report, Application No. PCT/GB 00/00731 (corresponding to U.S. 6,470,975), completion Dec. 14, 2000 (7 pages).
NL Examination Report, Application WO 00/52299 (corresponding to this U.S. Appl. No. 10/281,534), completed Dec. 19, 2003 (3 pages).
AU Examination Report, Application No. 28181/00 (corresponding to U.S. 6,263,982), Sep. 6, 2002 (1 page).
EU Examination Report, Application No. WO 00/906522.8-2315 (corresponding to U.S. 6,263,982), Nov. 29, 2004 (4 pages).
NO Examination Report, Application No. 20013952 (corresponding to U.S. 6,263,982), two pages English translation, Jul. 22, 2005 (4 pages).
International Preliminary Examination Report, Application No. PCT/GB00/00726 (corresponding to U.S. 6,263,982), completed Jun. 26, 2001 (10 pages).
Written Opinion, International Preliminary Examining Authority, Application No. PCT/GB00/00726 corresponding to U.S. 6,263,982), mailed Dec. 18, 2000 (7 pages).
International Search Report, Application No. PCT/GB00/00726 (corresponding to U.S. 6,263,982), completed May 3, 2000 (3 pages).
AU Examination Report, Application No. 27822/99 (corresponding to U.S. 6,138,774), Oct. 15, 2001 (1 page).
Supplementary European Search Report, Application No. 99908371.0-1266-US9903888 (corresponding to U.S. 6,138,774), completed Oct. 22, 2004 (3 pages).
NO Examination Report, Application No. 20003950 (corresponding to U.S. 6,138,774), one page English translation, Nov. 1, 2004 (3 pages).
International Search Report, Application No. PCT/US99/03888 (corresponding to U.S. 6,138,774), completed Jun. 24, 1999 (6 pages).
Written Opinion, International Preliminary Examining Authority, Application No. PCT/US99/03888 (corresponding to U.S. 6,138,744), mailed Dec. 21, 1999 (5 pages).
International Preliminary Examination Report, Application No. PCT/US99/03888 (corresponding to U.S. 6,138,774), completed May 4, 2000 (15 pages).
EU Examination Report, Application No. 05270083.8-2315 (corresponding to U.S. Pub. No. 2006/0108119 A1, now US 7,487,837 B2 published May 25, 2006), May 10, 2006 (11 pages).
Tangedahl, Michael J. et al., Rotating Preventers: Technology for better well control, World Oil®, Oct. 1992, vol. 213, No. 10, pp. 63-64 and 66 (see YYYY, 5X above), Gulf Publishing Company, Houston, Texas, © 1997 Gulf Publishing Company (3 pages).
GB Search Report, Application No. GB 0325423.2 (corresponding to above U.S. 7,040,394), searched Jan. 30, 2004 (one page).
GB Examination Report, Application No. GB 0325423.2 (corresponding to above 5Z), Jun. 30, 2005 (4 pages).
Dietle, Lannie L. et al., Kalsi Seals Handbook, Doc. 2137 Revision 1 (see in particular Forward p. ii for "Patent Rights"; Appendix A-6 for Kalsi seal part No. 381-6-* and A-10 for Kalsi seal part No. 432-32-* as discussed in U.S. Appl. No. 11/366,078, now US 2006/0144622 A1 at å's 70 and 71) Kalsi Engineering Inc, Sugar Land, Texas © 1992-2005 Kalsi Engineering, Inc. (167 pages).
Fig. 10 and discussion in U.S. Appl. No. 11/366,078 application of Background of Invention (2 pages) (see US Patent Publication No. US2006-0144622 A1 published on Jul. 6, 2006).
Partial European search report R.46 EPC dated Jun. 27, 2007 for European Patent Application EP07103416.9-2315 corresponding to above U.S. Appl. No. 11/366,078, now US 2006/0144622 A1 (5 pages).
Extended European search report R.44 EPC dated Oct. 9, 2007 for European Patent Application 07103416.9-2315 corresponding to above U.S. Appl. No. 11/366,078, now US 2006/0144622 A1 (8 pages).
U.S. Appl. No. 60/079,641, Mudlift System for Deep Water Drilling, filed Mar. 27, 1998, abandoned, but priority claimed in above US 6,230,824 B1 and 6,102,673 and PCT W099/50524 (54 pages).
U.S. Appl. No. 60/122,530, Concepts for the Application of Rotating Control Head Technology to Deepwater Drilling Operations, filed Mar. 2, 1999, abandoned, but priority claimed in above US 6,470,975 B1 (54 pages).
PCT/GB2008/050239 (corresponding to US2008/0210471 A1) Annex to Form PCT/ISA/206 Communication Relating to the Results of the Partial International Search dated Aug. 26, 2008 (4 pages).
PCT/GB2008/050239 (corresponding to US2008/0210471 A1) International Search Report and Written Opinion of the International Searching Authority (16 pages).
Vetco Gray Product Information CDE-PI-0007 dated Mar. 1999 for 59.0" Standard Bore CSO Diverter (2 pages) © 1999 by Vetco Gray Inc.
Vetco Gray Capital Drilling Equipment KFDJ and KFDJ Model "J" Diverters (1 page) (no date).
Hydril Blowout Preventers Catalog M-9402 D (44 pages) © 2004 Hydrill Company LP; see annular and ram BOP seals on p. 41.
Hydril Compact GK® 7 1/16"-3000 & 5000 psi Annular Blowout Preventers, Catalog 9503B © 1999 Hydril Company (4 pages).
Weatherford Controlled Pressure Drilling *Williams*® Rotating Marine Diverter Insert (2 pages).
Weatherford Controlled Pressure Drilling Model 7800 Rotating Control Device © 2007 Weatherford(5 pages).
Weatherford Controlled Pressure Drilling® and Testing Services *Williams*® Model 8000/9000 Conventional Heads © 2002-2006 Weatherford(2 pages).
Weatherford "Real Results Rotating Control Device Resolves Mud Return Issues in Extended-Reach Well, Saves Equipment Costs and Rig Time" © 2007 Weatherford and "Rotating Control Device Ensures Safety of Crew Drilling Surface-Hole Section" © 2008 Weatherford (2 pages).
Washington Rotating Control Heads, Inc. Series 1400 Rotating Control Heads ("Shorty") printed Nov. 21, 2008 (2 pages).
Smith Services product details for Rotating Control Device—RDH 500® printed Nov. 24, 2008 (4 pages).
American Petroleum Institute Specification for Drill Through Equipment—Rotating Control Devices, API Specification 16RCD, First Edition, Feb. 2005 (84 pages).
Weatherford Drilling & Intervention Services Underbalanced Systems RPM System 3000™ Rotating Blowout Preventer, Setting a New Standard in Well Control, An Advanced Well Control System for Underbalanced Drilling Operations, Brochure #333.00, © 2002 Weatherford (4 pages).
Medley, George; Moore, Dennis; Nauduri, Sagar; Signa Engineering Corp.; SPE/IADC Managed Pressure Drilling & Underbalanced Operations (PowerPoint presentation; 22 pages).
Secure Drilling Well Controlled, Secure Drilling™ System using Micro-Flux Control Technology, © 2007 Secure Drilling (12 pages).
The LSU Petroleum Engineering Research & Technology Transfer Laboratory, 10-rate Step Pump Shut-down and Start-up Example Procedure for Constant Bottom Hole Pressure Manage Pressure Drilling Applications (8 pages).
United States Department of the Interior Minerals Management Service Gulf of Mexico OCS Region NTL No. 2008-G07; Notice to Lessees and Operators of Federal Oil, Gas, and Sulphur Leases in the Outer Continental Shelf, Gulf of Mexical OCS Region, Managed Pressure Drilling Projects; Issue Date: May 15, 2008; Effective Date: Jun. 15, 2008; Expiration Date: Jun. 15, 2013 (9 pages).
Gray, Kenneth; Dynamic Density Control Quantifies Well Bore Conditions in Real Time During Drilling; American Oil & Gas Reporter, Jan. 2009 (4 pages).
Kotow, Kenneth J.; Pritchard, David M.; Riserless Drilling with Casing: A New Paradigm for Deepwater Well Design, OTC-19914-PP, © 2009 Offshore Technology Conference, Houston, TX May 4-7, 2009 (13 pages).
Hannegan, Don M.; Managed Pressure Drilling—A New Way of Looking at Drilling Hydraulics—Overcoming Conventional Drilling Challenges; SPE 2006-2007 Distinguished Lecturer Series presentation (29 pages).
Turck Works Industrial Automation; Factor 1 Sensing for Metal Detection (2 pages) (no date).

Balluff Sensors Worldwide; Object Dectection Catalog Aug. 2009—Industive Proximity Sensors for Non-Contact Detection of Metallic Targets at Ranges Generally under 50mm (2 inches); Linear Position and Measurement; Linear Position Transducers; Inductive Distance Sensors; Photoelectric Distance Sensors; Magneto-Inductive Linear Position Sensors; Magnetic Linear/Rotary Encoder System; printed Dec. 23, 2008 (8 pages).

AC 2-Wire Tubular Sensors, Balluff product catalog pp. 1.109-1.120 (12 pages) (no date).

DC 2-Wire Tubular Sensors, Balluff product catalog pp. 1.125-1.136 (12 pages) (no date).

Analog Inductive Sensors, Balluff product catalog pp. 1.157-1.170 (14 pages) (no date).

DC 3-/4-Wire Inductive Sensors, Balluff product catalog pp. 1.72-1.92 (21 pages).

Selecting Position Transducers: How to Choose Among Displacement Sensor Technologies; How to Choose Among Draw Wire, LVDT, RVDT, Potentiometer, Optical Encoder, Ultrasonic, Magnetostrictive, and Other Technologies; © 2009 M-I, LLC © 1996-2010 Space Age Control, Inc., printed Feb. 18, 2010 (6 pages).

Liquid Flowmeters, Omega.com website; printed Jan. 26, 2009 (13 pages).

Super Autochoke—Automatic Pressure Regulation Under All Conditions © 2009 M-I, LLC; MI Swaco website; printed Apr. 2, 2009 (1 page).

ROTATING CONTROL DEVICE DOCKING STATION

CROSS-REFERENCE TO RELATED APPLICATIONS

This application is a continuation-in-part of application Ser. No. 10/995,980 filed Nov. 23, 2004 now U.S. Pat. No. 7,487,837, which Application is hereby incorporated by reference for all purposes in its entirety.

This application is a continuation-in-part of application Ser. No. 11/366,078 filed Mar. 2, 2006 now U.S. Pat. No. 7,836,946, which is a continuation-in-part of application Ser. No. 10/995,980 filed on Nov. 23, 2004 now U.S. Pat. No. 7,487,837, which Applications are hereby incorporated by reference for all purposes in their entirety.

This application claims the benefit of provisional Application No. 60/921,565 filed Apr. 3, 2007, which Application is hereby incorporated by reference for all purposes in its entirety.

STATEMENT REGARDING FEDERALLY SPONSORED RESEARCH OR DEVELOPMENT

N/A

REFERENCE TO MICROFICHE APPENDIX

N/A

BACKGROUND OF THE INVENTION

1. Field of the Invention

This invention relates to the field of oilfield equipment, and in particular to a system and method for conversion between conventional hydrostatic pressure drilling to managed pressure drilling or underbalanced drilling using a rotating control device.

2. Description of the Related Art

Marine risers are used when drilling from a floating rig or vessel to circulate drilling fluid back to a drilling structure or rig through the annular space between the drill string and the internal diameter of the riser. Typically a subsea blowout prevention (BOP) stack is positioned between the wellhead at the sea floor and the bottom of the riser. Occasionally a surface BOP stack is deployed atop the riser instead of a subsea BOP stack below the marine riser. The riser must be large enough in internal diameter to accommodate the largest drill string that will be used in drilling a borehole. For example, risers with internal diameters of 21¼ inches have been used, although other diameters can be used. A 21¼ inch marine riser is typically capable of 500 psi pressure containment. Smaller size risers may nave greater pressure containment capability. An example of a marine riser and some of the associated drilling components, such as shown in FIGS. 1 and 2, is proposed in U.S. Pat. No. 4,626,135.

The marine riser is not used as a pressurized containment vessel during conventional drilling operations. Drilling fluid and cuttings returns at the surface are open-to-atmosphere under the rig floor with gravity flow away to shale shakers and other mud handling equipment on the floating vessel. Pressures contained by the riser are hydrostatic pressure generated by the density of the drilling fluid or mud held in the riser and pressure developed by pumping of the fluid to the borehole. Although operating companies may have different internal criteria for determining safe and economic drill-ability of prospects in their lease portfolio, few would disagree that a growing percentage are considered economically undrillable with conventional techniques. In fact, the U.S. Department of the Interior has concluded that between 25% and 33% of all remaining undeveloped reservoirs are not drillable by using conventional overbalanced drilling methods, caused in large part by the increased likelihood of well control problems such as differential sticking, lost circulation, kicks, and blowouts.

In typical conventional drilling with a floating drilling rig, a riser telescoping or slip joint, usually positioned between the riser and the floating drilling rig, compensates for vertical movement of the drilling rig. Because the slip joint is atop the riser and open-to-atmosphere, the pressure containment requirement is typically only that of the hydrostatic head of the drilling fluid contained within the riser. Inflatable seals between each section of the slip joint govern its pressure containment capability. The slip joint is typically the weakest link of the marine riser system in this respect. The only way to increase the slip joint's pressure containment capability would be to render it inactive by collapsing the slip joint inner barrel(s) into its outer barrel(s), locking the barrels in place and pressurizing the seals. However, this eliminates its ability to compensate for the relative movement between the marine riser and the floating rig. Such riser slips joints are expensive to purchase, and expensive to maintain and repair as the seals often have to be replaced.

Pore pressure depletion, the hydraulics associated with drilling in deeper water, and increasing drilling costs indicate that the amount of known resources considered economically undrillable with conventional techniques will continue to increase. New and improved techniques, such as underbalanced drilling (UBD) and managed pressure drilling (MPD), have been used successfully throughout the world in certain offshore drilling environments. Both technologies are enabled by drilling with a closed and pressurizable circulating fluid system as compared to a drilling system that is open-to-atmosphere at the surface. Managed pressure drilling (MPD) has recently been approved for use in the Gulf of Mexico by the U.S. Department of the Interior, Minerals Management Service, Gulf of Mexico Region. Managed pressure drilling is an adaptive drilling process used to more precisely control the annular pressure profile throughout the wellbore. MPD addresses the drill-ability of a prospect, typically by being able to adjust the equivalent mud weight with the intent of staying within a "drilling window" to a deeper depth and reducing drilling non-productive time in the process. The drilling window changes with depth and is typically described as the equivalent mud weight required to drill between the formation pressure and the pressure at which an underground blowout or loss of circulation would occur. The equivalent weight of the mud and cuttings in the annulus is controlled with fewer interruptions to drilling progress while being kept above the formation pressure at all times. An influx of formation fluids is not invited to flow to the surface while drilling. Underbalanced drilling (UBD) is drilling with the hydrostatic head of the drilling fluid intentionally designed to be lower than the pressure of the formations being drilled, typically to improve the well's productivity upon completion by avoiding invasive mud and cuttings damage while drilling. An influx of formation fluids is therefore invited to flow to the surface while drilling. The hydrostatic head of the fluid may naturally be less than the formation pressure, or it can be induced.

These techniques present a need for pressure management devices when drilling with jointed pipe, such as rotating control heads or devices (referred to as RCDs). RCDs, such as disclosed in U.S. Pat. No. 5,662,181, have provided a dependable seal between a rotating tubular and the marine riser for purposes of controlling the pressure or fluid flow to the surface while drilling operations are conducted. Typically, an inner portion or member of the RCD is designed to seal around a rotating tubular and rotate with the tubular by use of an internal sealing element(s) and bearings. Additionally, the inner portion of the RCD permits the tubular to move axially and slidably through the RCD. The term "tubular" as used herein means all forms of drill pipe, tubing, casing, drill collars, liners, and other tubulars for oilfield operations as is understood in the art.

U.S. Pat. No. 6,138,774 proposes a pressure housing assembly containing a RCD and an adjustable constant pressure regulator positioned at the sea floor over the well head for drilling at least the initial portion of the well with only sea water, and without a marine riser. As best shown in FIG. 6 of the '774 patent, the proposed pressure housing assembly has a lubrication unit for lubricating the RCD. The proposed lubrication unit has a lubricant chamber, separated from the borehole pressure chamber, having a spring activated piston, or alternatively, the spring side of the piston is proposed to be vented to sea water pressure. The adjustable constant pressure regulator is preferably pre-set on the drilling rig (Col. 6, Ins. 35-59), and allows the sea water circulated down the drill string and up the annulus to be discharged at the sea floor.

U.S. Pat. No. 6,913,092 B2 proposes a seal housing containing a RCD positioned above sea level on the upper section of a marine riser to facilitate a mechanically controlled pressurized system that is useful in underbalanced sub sea drilling. The exposed RCD is not enclosed in any containment member, such as a riser, and as such is open to atmospheric pressure. An internal running tool is proposed for positioning the RCD seal housing onto the riser and facilitating its attachment thereto. A remote controlled external disconnect/connect clamp is proposed for hydraulically clamping the bearing and seal assembly of the RCD to the seal housing. As best shown in FIG. 3 of the '092 patent, in one embodiment, the seal housing of the RCD is proposed to contain two openings to respective T-connectors extending radially outward for the return pressurized drilling fluid flow, with one of the two openings closed by a rupture disc fabricated to rupture at a predetermined pressure less than the maximum allowable pressure capability of the marine riser. Both a remotely operable valve and a manual valve are proposed on each of the T-connectors. As proposed in FIG. 2 of the '092 patent, the riser slip joint is locked in place so that there is no relative vertical movement between the inner barrel and the outer barrel of the riser slip joint. After the seals in the riser slip joint are pressurized, this locked riser slip joint can hold up to 500 psi for most 21¼ marine riser systems.

It has also become known to use a dual density fluid system to control formations exposed in the open borehole. See Feasibility Study of a Dual Density Mud System For Deepwater Drilling Operations by Clovis A. Lopes and Adam T. Bourgoyne, Jr., © 1997 Offshore Technology Conference. As a high density mud is circulated to the rig, gas is proposed in the 1997 paper to be injected into the mud column in the riser at or near the ocean floor to lower the mud density. However, hydrostatic control of formation pressure is proposed to be maintained by a weighted mud system, that is not gas-cut, below the seafloor.

U.S. Pat. No. 6,470,975 B1 proposes positioning an internal housing member connected to a RCD below sea level with a marine riser with an annular type blowout preventer ("BOP") with a marine diverter, an example of which is shown in the above discussed U.S. Pat. No. 4,626,135. The internal housing member is proposed to be held at the desired position by closing the annular seal of the BOP on it so that a seal is provided in the annular space between the internal housing member and the inside diameter of the riser. The RCD can be used for underbalanced drilling, a dual density fluid system, or any other drilling technique that requires pressure containment. The internal housing member is proposed to be run down the riser by a standard drill collar or stabilizer.

U.S. Pat. No. 7,159,669 B2 proposes that the RCD held by an internal housing member be self-lubricating. The RCD proposed is similar to the Weatherford-Williams Model 7875 RCD available from Weatherford International, Inc. of Houston, Tex. Accumulators holding lubricant, such as oil, are proposed to be located near the bearings in the lower part of the RCD bearing assembly. As the bearing assembly is lowered deeper into the water, the pressure in the accumulators increase, and the lubricant is transferred from the accumulators through the bearings, and through a communication port into an annular chamber. As best shown in FIG. 35 of the '669 patent, lubricant behind an active seal in the annular chamber is forced back through the communication port into the bearings and finally into the accumulators, thereby providing self-lubrication. In another embodiment, it is proposed that hydraulic connections can be used remotely to provide increased pressure in the accumulators to move the lubricant. Recently, RCDs, such as proposed in U.S. Pat. Nos. 6,470,975 and 7,159,669, have been suggested to serve as a marine riser annulus barrier component of a floating rig's swab and surge pressure compensation system. These RCDs would address piston effects of the bottom hole assembly when the floating rig's heave compensator is inactive, such as when the bit is off bottom.

Pub. No. US 2006/0108119 A1 proposes a remotely actuated hydraulic piston latching assembly for latching and sealing a RCD with the upper section of a marine riser or a bell nipple positioned on the riser. As best shown in FIG. 2 of the '119 publication, a single latching assembly is proposed in which the latch assembly is fixedly attached to the riser or bell nipple to latch an RCD with the riser. As best shown in FIG. 3 of the '119 publication, a dual latching assembly is also proposed in which the latch assembly itself is latchable to the riser or bell nipple, using a hydraulic piston mechanism. A lower accumulator (FIG. 5) is proposed in the RCD, when hoses and lines cannot be used, to maintain hydraulic fluid pressure in the lower portion of the RCD bearing assembly. The accumulator allows the bearings to be self-lubricated. An additional accumulator (FIG. 4) in the upper portion of the bearing assembly of the RCD is also proposed for lubrication.

Pub. No. US 2006/0144622 A1 proposes a system and method for cooling a RCD while regulating the pressure on its upper radial seal. Gas, such as air, and liquid, such as oil, are alternatively proposed for use in a heat exchanger in the RCD. A hydraulic control is proposed to provide fluid to energize a bladder of an active seal to seal around a drilling string and to lubricate the bearings in the RCD.

U.S. Pat. Nos. 6,554,016 B1 and 6,749,172 B1 propose a rotary blowout preventer with a first and a second fluid lubricating, cooling, and filtering circuit separated by a seal. Adjustable orifices are proposed connected to the outlet of the first and second fluid circuits to control pressures within the circuits.

The above discussed U.S. Pat. Nos. 4,626,135; 5,662,181; 6,138,774; 6,470,975 B1; 6,554,016 B1; 6,749,172 B1; 6,913,092 B2; and 7,159,669 B2; and Pub. Nos. U.S. 2006/0108119 A1; and 2006/0144622 A1 are incorporated herein by reference for all purposes in their entirety. With the exception of the '135 patent, all of the above referenced patents and patent publications have been assigned to the assignee of the present invention. The '135 patent is assigned on its face to the Hydril Company of Houston, Tex.

Drilling rigs are usually equipped with drilling equipment for conventional hydrostatic pressure drilling. A need exists for a system and method to efficiently and safely convert the rigs to capability for managed pressure drilling or underbalanced drilling. The system should require minimal human intervention, particularly in the moon pool area of the rig, and provide an efficient and safe method for positioning and removing the equipment. The system should minimize or eliminate the need for high pressure slip joints in the marine riser. The system should be compatible with the common conventional drilling equipment found on typical rigs. The system should allow for compatibility with a variety of different types of RCDs. Preferably, the system and method should allow for the reduction of RCD maintenance and repairs by allowing for the efficient and safe lubrication and cooling of the RCDs while they are in operation.

BRIEF SUMMARY OF THE INVENTION

A system and method for converting a drilling rig from conventional hydrostatic pressure drilling to managed pressure drilling or underbalanced drilling is disclosed that utilizes a docking station housing. The docking station housing is mounted on a marine riser or bell nipple. The housing may be positioned above the surface of the water. A rotating control device can be moved through the well center with a remote hydraulically activated running tool and remotely hydraulically latched. The rotating control device can be interactive so as to automatically and remotely lubricate and cool from the docking station housing while providing other information to the operator. The system may be compatible with different rotating control devices and typical drilling equipment. The system and method allow for conversion between managed pressure drilling or underbalanced drilling to conventional drilling as needed, as the rotating control device can be remotely latched to or unlatched from the docking station housing and moved with a running tool or on a tool joint. A containment member allows for conventional drilling after the rotating control device is removed. A docking station housing telescoping or slip joint in the containment member both above the docking station housing and above the surface of the water reduces the need for a riser slip joint or its typical function in the marine riser.

BRIEF DESCRIPTION OF THE DRAWINGS

A better understanding of the present invention can be obtained with the following detailed descriptions of the various disclosed embodiments in the drawings.

DETAILED DESCRIPTION OF THE INVENTION

Figure 1:
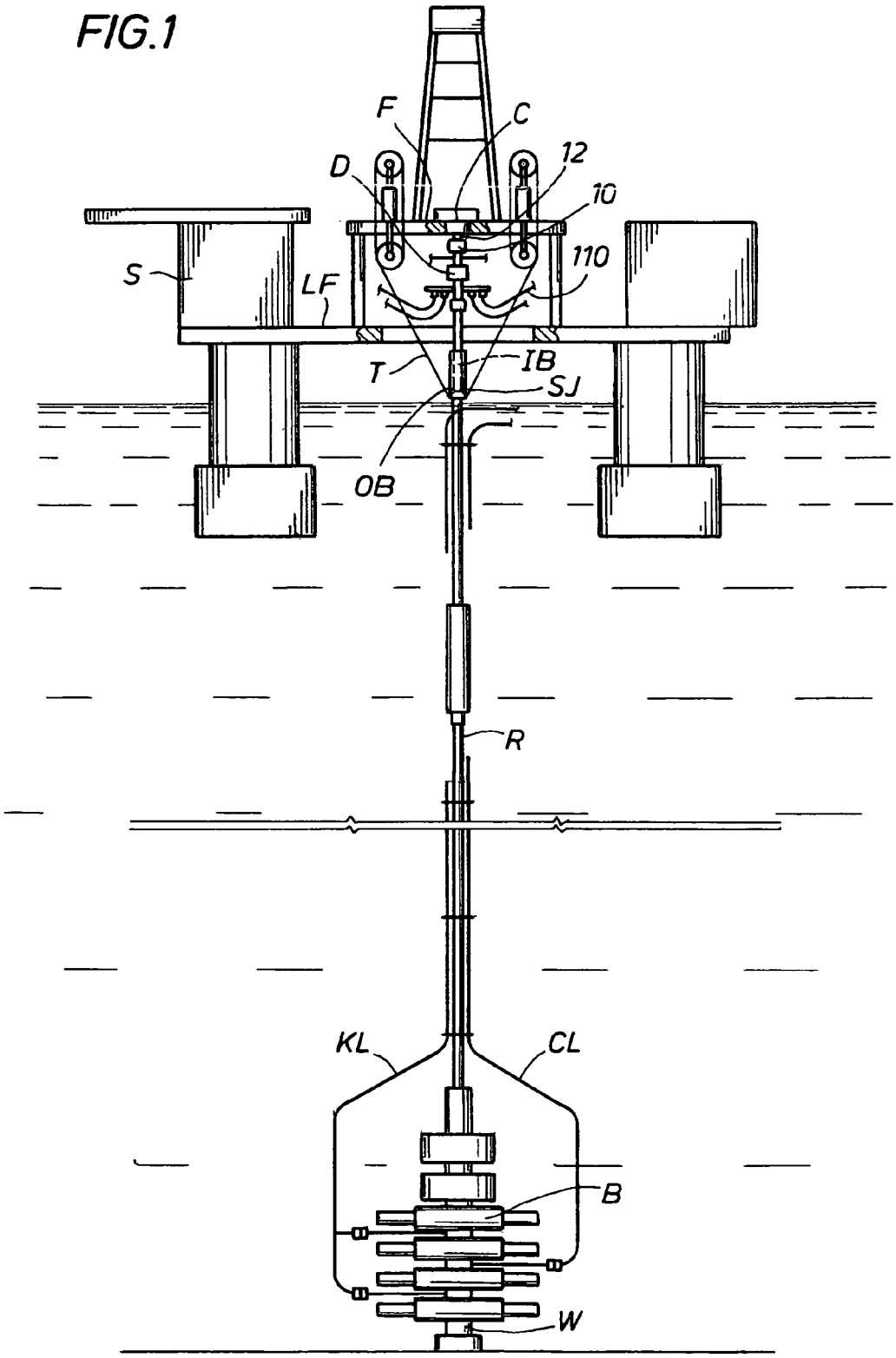
FIG. 1 is an elevational view of an exemplary embodiment of a floating semi-submersible drilling rig showing a BOP stack on the ocean floor, a marine riser, the docking station housing of the present invention, and the containment member.
Figure 2:
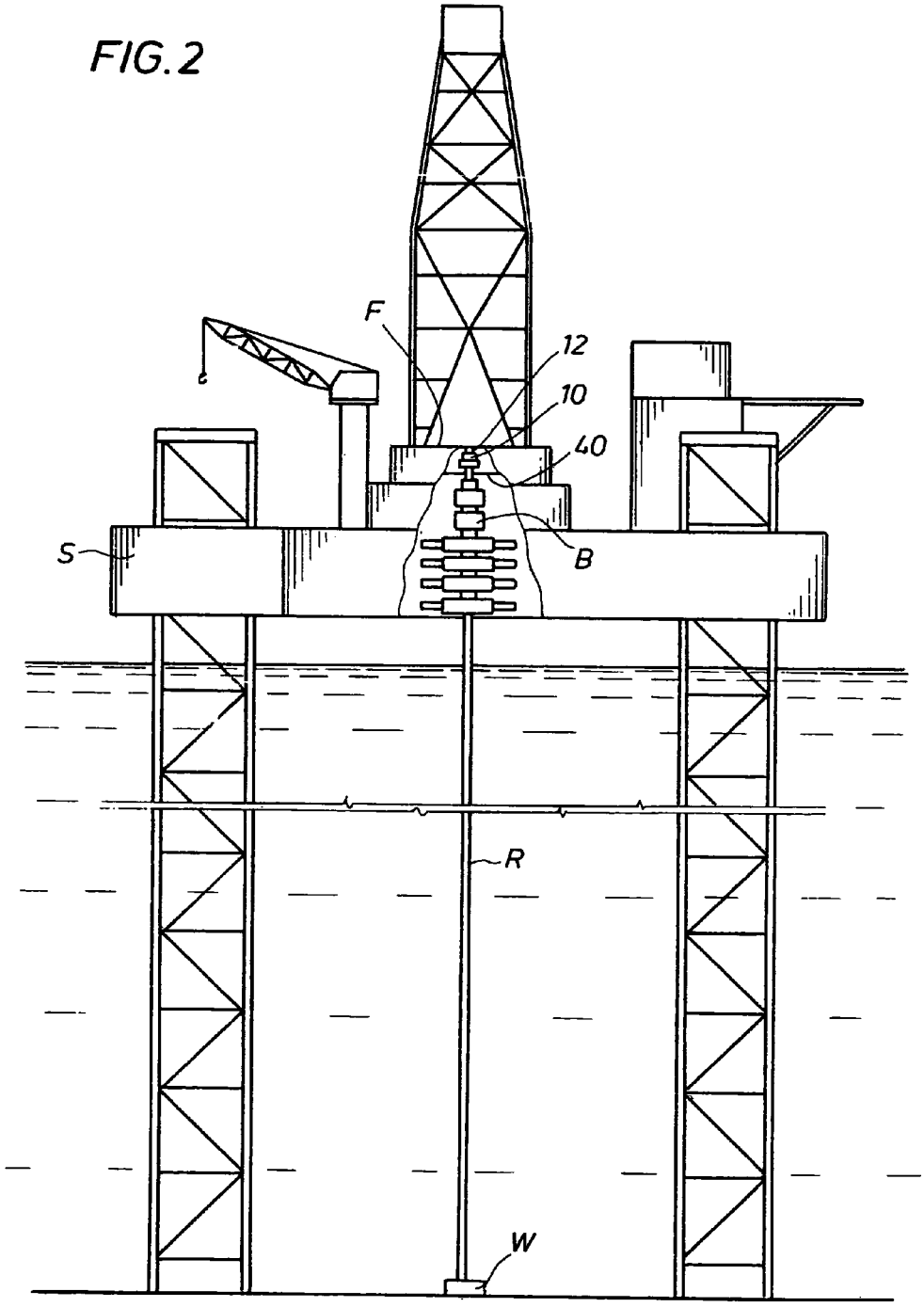
FIG. 2 is an elevational view of an exemplary embodiment of a fixed jack up drilling rig showing a marine riser, a BOP stack above the surface of the water, the docking station housing of the present invention, and the containment member.

Generally, the present invention involves a system and method for converting an offshore and/or land drilling rig or structure S between conventional hydrostatic pressure drilling and managed pressure drilling or underbalanced drilling using a docking station housing, designated as 10 in FIGS. 1 and 2. As will be discussed later in detail, the docking station housing 10 has a latching mechanism. The housing is designated in FIGS. 3 to 13 as 10A, 10B, or 10C depending on the latching mechanism contained in the housing. The docking station housing 10 is designated as 10A if it has a single latching assembly (FIG. 6A), as 10B if it has a dual latching assembly (FIG. 4B), and as 10C if it has a J-hooking latching assembly (FIG. 8). It is contemplated that the three different types of latching assemblies (as shown with housing 10A, 10B, and 10C) can be used interchangeably. As will also be discussed later in detail, the docking station housing 10 at least provides fluid, such as gas or liquid, to the RCD 14 when the RCD 14 is latched into vertical and rotational alignment with the housing 10.

For the floating drilling rig, the housing 10 may be mounted on the marine riser R or a bell nipple above the surface of the water. It is also contemplated that the housing 10 could be mounted below the surface of the water. An RCD 14 can be lowered through well center C with a remotely actuated hydraulic running tool 50 so that the RCD 14 can be remotely hydraulically latched to the housing 10. The docking station housing 10 provides the means for remotely lubricating and cooling a RCD 14. The docking station housing 10 remotely senses when a self-lubricating RCD 14 is latched into place. Likewise, the docking station housing 10 remotely senses when an RCD 14 with an internal cooling system is latched into place. The lubrication and cooling controls can be automatic, operated manually, or remotely controlled. Other sensors with the docking station housing 10 are contemplated to provide data, such as temperature, pressure, density, and/or fluid flow and/or volume, to the operator or the operating CPU system.

The operator can indicate on a control panel which RCD 14 model or features are present on the RCD 14 latched into place. When a self-lubricating RCD 14 or an RCD 14 with an active seal is latched into the docking station housing 10, a line and supporting operating system is available to supply seal activation fluid in addition to cooling and lubrication fluids. At least six lines to the housing 10 are contemplated, including lines for lubrication supply and return, cooling supply and return, top-up lubrication for a self-lubricating RCD 14, and active seal inflation. A top-up line may be necessary if the self-lubricating RCD 14 loses or bleeds fluid through its rotating seals during operation. It is further contemplated that the aforementioned lines could be separate or an all-in-one line for lubrication, cooling, top-up, and active seal inflation. It is also contemplated that regardless of whether a separate or an all-in-one line is used, return lines could be eliminated or, for example, the lubrication and cooling could be a "single pass" with no returns. It is further contemplated that pressure relief mechanisms, such as rupture discs, could be used on return lines.

A cylindrical containment member 12 is positioned below the bottom of the drilling deck or floor F or the lower deck or floor LF and above the docking station housing 10 for drilling fluid flow through the annular space should the RCD 14 be removed. For floating drilling rigs or structures, a docking station housing telescoping or slip joint 99 used with the containment member 12 above the surface of the water reduces the need for a riser slip joint SJ in the riser R. The location of the docking station housing slip joint 99 above the surface of the water allows for the pressure containment capability of the docking station housing joint 99 to be relatively low, such as for example 5 to 10 psi. It should be understood that any joint in addition to a docking station housing slip joint 99 that allows for relative vertical movement is contemplated.

Exemplary drilling rigs or structures, generally indicated as S, are shown in FIGS. 1 and 2. Although an offshore floating semi-submersible rig S is shown in FIG. 1, and a fixed jack-up rig S is shown in FIG. 2, other drilling rig configurations and embodiments are contemplated for use with the present invention for both offshore and land drilling. For example, the present invention is equally applicable to drilling rigs such as semi-submersibles, submersibles, drill ships, barge rigs, platform rigs, and land rigs. Turning to FIG. 1, an exemplary embodiment of a drilling rig S converted from conventional hydrostatic pressure drilling to managed pressure drilling and underbalanced drilling is shown. A BOP stack B is positioned on the ocean floor over the wellhead W. Conventional choke CL and kill KL lines are shown for well control between the drilling rig S and the BOP stack B.

A marine riser R extends from the top of the BOP stack B and is connected to the outer barrel OB of a riser slip or telescopic joint SJ located above the water surface. The riser slip joint SJ may be used to compensate for relative vertical movement of the drilling rig S to the riser R when the drilling rig S is used in conventional drilling. A marine diverter D, such as disclosed in U.S. Pat. No. 4,626,135, is attached to the inner barrel IB of the riser slip joint SJ. Flexible drilling fluid or mud return lines 110 for managed pressure drilling or underbalanced drilling extend from the diverter D. Tension support lines T connected to a hoist and pulley system on the drilling rig S support the upper riser R section. The docking station housing 10 is positioned above the diverter D. The containment member 12 is attached above the docking station housing 10 and below the drilling deck or floor F, as shown in FIGS. 1, 2, 4A, 6 and 9-13. The containment member 12 of FIG. 1 is not shown with a docking station housing telescoping or slip joint 99 due to the riser slip joint SJ located below the diverter D.

In FIG. 2 the fixed drilling rig S is shown without a slip joint in either the riser R or for use with the containment member 12. Further, rigid or flexible drilling fluid return lines 40 may be used with the fixed drilling rig S.

Figure 3B:
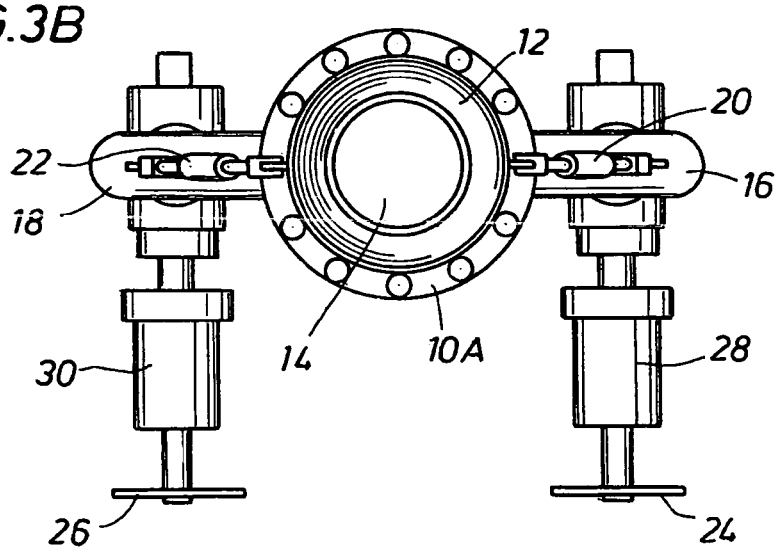
FIG. 3B is a plan view of FIG. 3A.
Figure 3A:
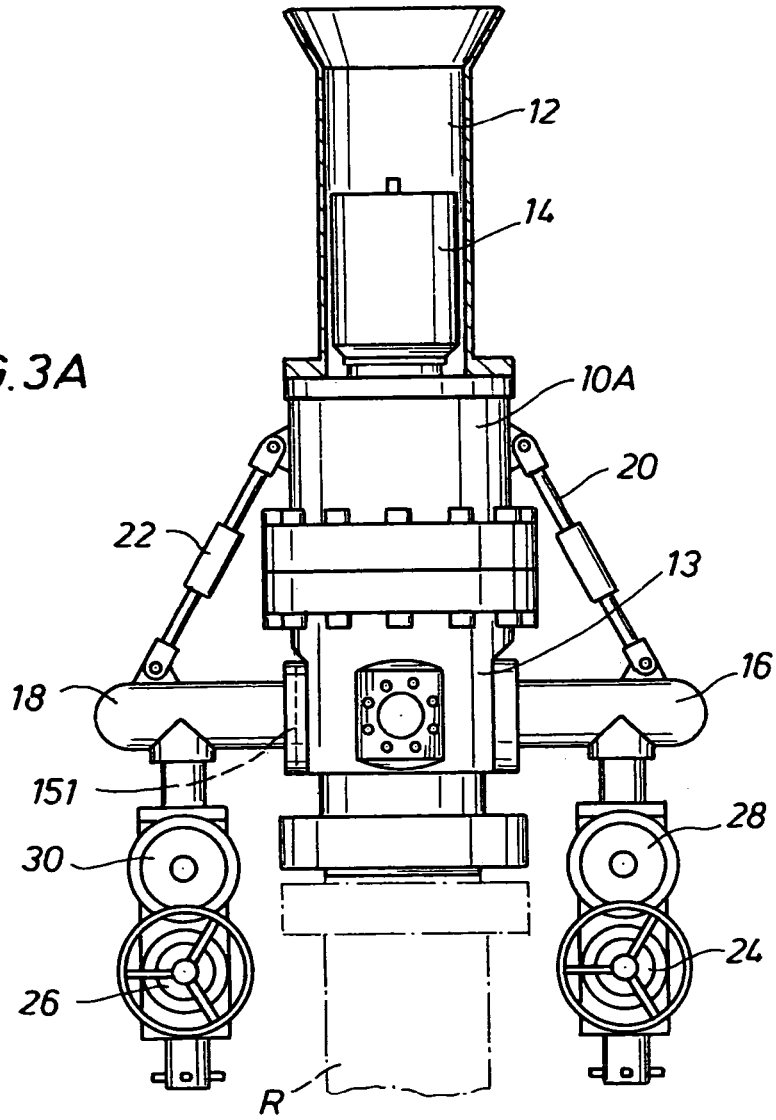
FIG. 3A is a elevational view of the docking station housing of the present invention with a latched RCD and the containment member.

Turning to FIGS. 3A and 3B, a RCD 14 is latched into the docking station housing 10A. The containment member 12 is mounted on the docking station housing 10A. The docking station housing 10A is mounted on a bell nipple 13 with two T-connectors (16, 18) extending radially outward. As will become apparent later in the discussion of FIG. 6, the connection between the docking station housing 10A and the bell nipple 13 reveals that the docking station housing 10A has a single latching mechanism, such as 78 shown in FIG. 6A. Tension straps (20, 22) support the T-connectors (16, 18), respectively. Manual valves (24, 26) and remotely operable valves (28, 30) extend downwardly from the T-connectors (16, 18), and are connected with conduits (not shown) for the movement of drilling fluid when the annular space is sealed for managed pressure or underbalanced drilling. It is contemplated that a rupture disc 151, shown in phantom view, fabricated to rupture at a predetermined pressure, be used to cover one of the two openings in the docking station housing 10 leading to the T-connectors (16, 18).

Figure 4A:
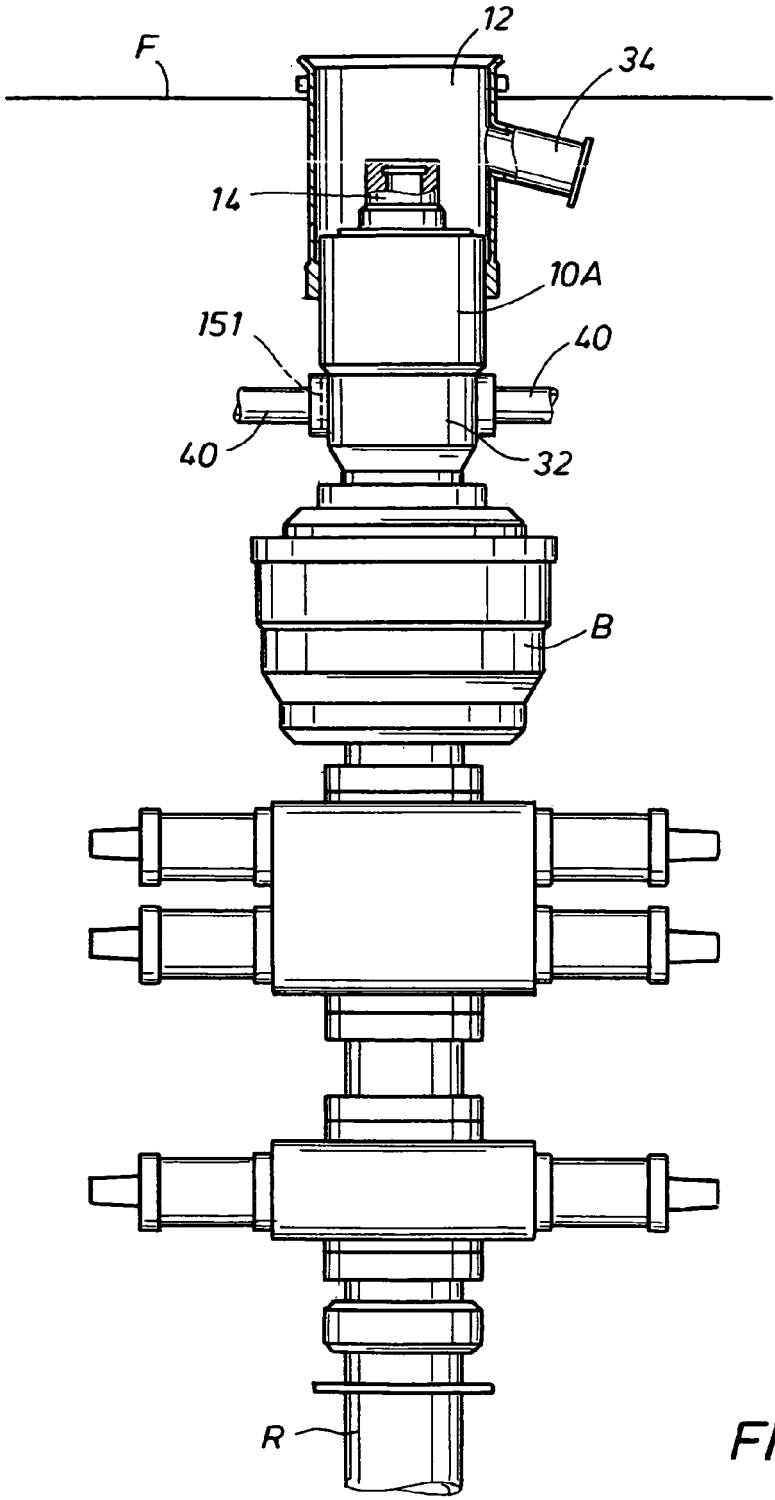
FIG. 4A is an elevational view of the docking station housing of the present invention mounted with an above sea BOP stack, with the containment member and top of the RCD shown cut away.

Turning to FIG. 4A, a fixed drilling rig, similar to the one shown in FIG. 2, docking station housing 10A is attached to a bell nipple 32 mounted on the top of a BOP stack B positioned above the riser R. Rigid drilling fluid return lines 40 extend radially outward from the bell nipple 32. It should be understood that flexible conduits are also contemplated to be used in place of rigid lines for a fixed drilling rig. A RCD 14 (in cut away section view) is latched into the docking station housing 10A using one of the single latching mechanisms disclosed in Pub. No. U.S. 2006/0108119 A1. Again, as will become apparent later in the discussion of FIG. 6, the connection between the docking station housing 10A and the bell nipple 32 reveals that the docking station housing 10A has a single latching mechanism, such as 78 shown in FIG. 6A.

Figure 6:
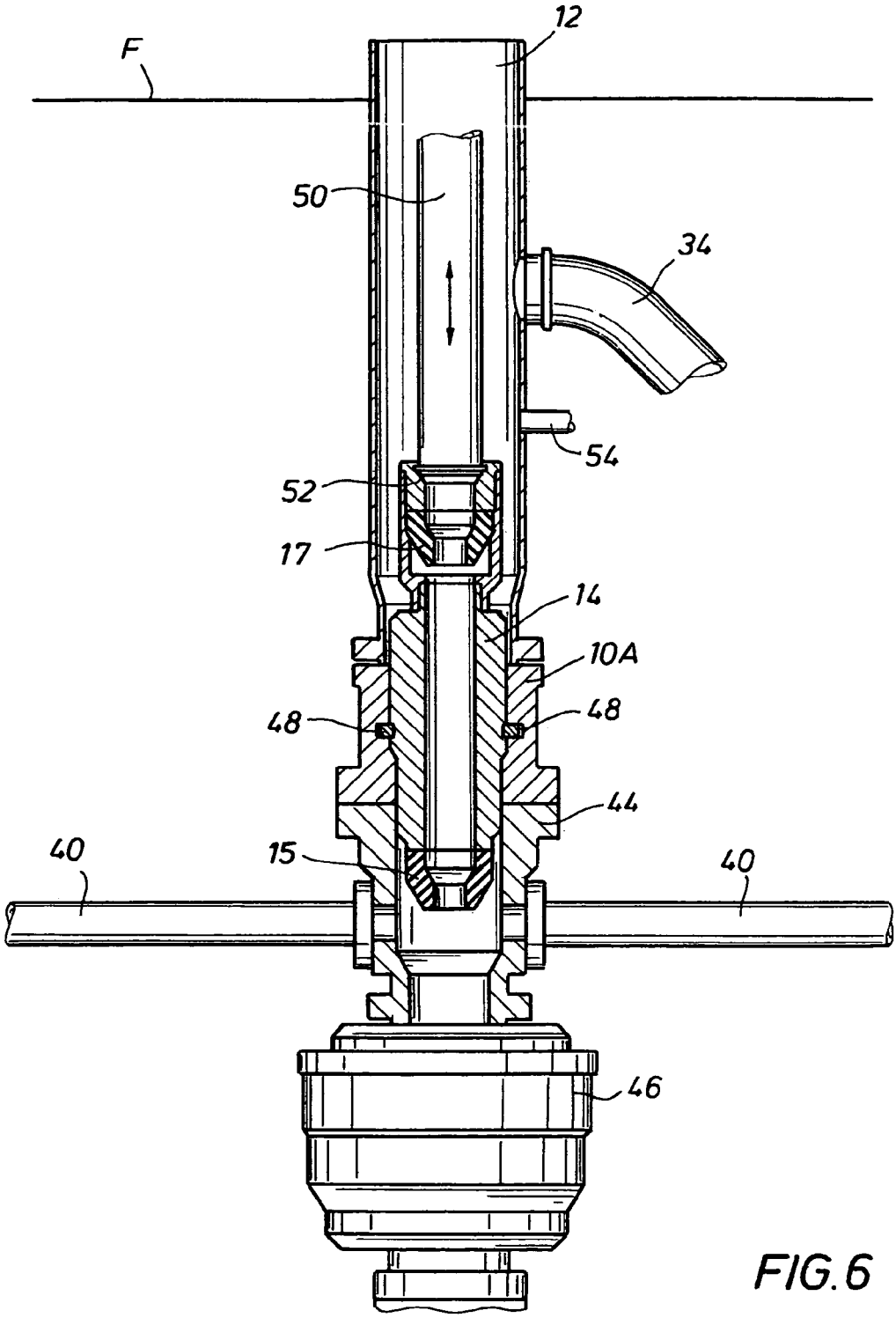
FIG. 6 is a section elevational view of a RCD latched into the docking station housing of the present invention, the containment member, and a hydraulic running tool used to remove/install the RCD.

However, it is contemplated that a single latching assembly, a dual latching assembly, or a J-hooking latching assembly (as shown in housing 10A, 10B, and 10C, respectively) could be used interchangeably. The RCD 14 is shown without a top stripper rubber seal similar to seal 17 (FIG. 6). It should be understood that an RCD 14 with a top stripper rubber seal 17 is also contemplated. The containment member 12 is attached between the docking station housing 10 and the bottom of the drilling deck, which is shown schematically as F. An outlet 34 extends from the containment member 12 and can be connected to a conduit for drilling fluid returns in conventional drilling with the RCD 14 removed. It is contemplated that a rupture disc, such as disc 151 shown in phantom view, be used to cover one of the two openings in the bell nipple 32 leading to pipes 40. It is also contemplated that one of the openings could be capped.

Figure 4B:
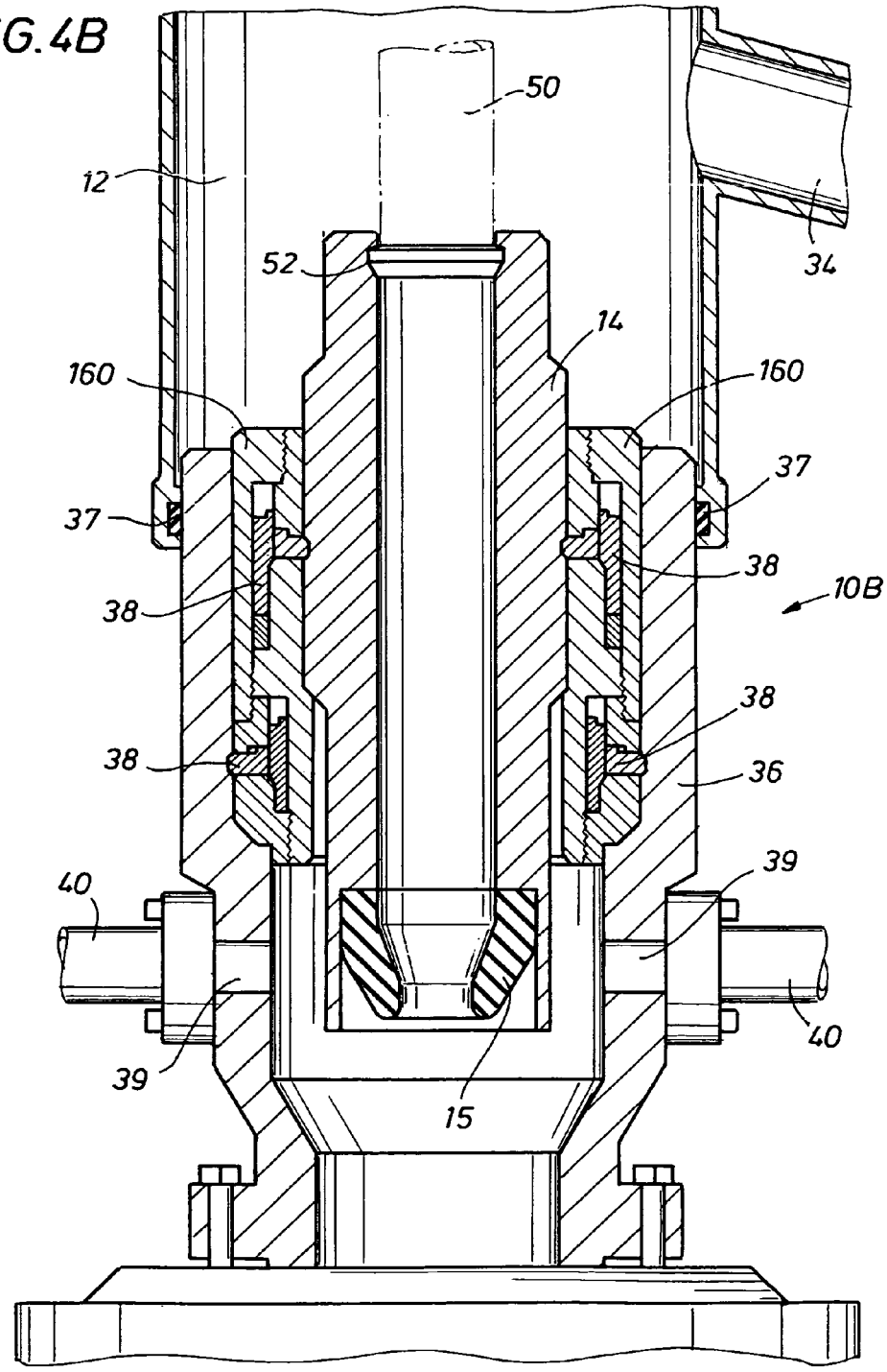
FIG. 4B is an elevational section view of a RCD latched into the docking station housing of the present invention, and the slidable containment member.

FIG. 4B shows the docking station housing 10B, comprising a bell nipple 36 and a latching assembly housing 160. A RCD 14 with a single stripper rubber seal 15 is latched into the docking station housing 10B. Notwithstanding the type of RCD 14 shown in any of the FIGS. 1-14, including FIG. 4B, it is contemplated that the docking station housing 10 of the present invention can be sized and configured to hold any type or size RCD 14 with any type or combination of RCD seals, such as dual stripper rubber seals (15 and 17), single stripper rubber seals (15 or 17), single stripper rubber seal (15 or 17) with an active seal, and active seals. A dual latching assembly 38, such as described in Pub. No. U.S. 2006/0108119 A1, could be used in the docking station housing 10B. The dual latching assembly 38 is used due to the wall height of the bell nipple 36. While the lubrication and cooling systems of the docking station housing 10B are not shown in FIG. 4B, it is contemplated that at least one of the channels (not shown) would run through both the latch assembly housing 160 and the bell nipple 36 for at least one of such lubrication and cooling systems. It is also contemplated that channels could be run for lubrication supply and return, cooling supply and return, top-up lubrication, and active seal inflation. Although a dual latching assembly 38 is shown, a single latching system also described in the '119 patent publication is contemplated, as is a J-hooking latching assembly.

Two openings 39 in the lower bell nipple 36 connect to piping 40 for drilling fluid return flow in managed pressure or underbalanced drilling. The containment member 12 is slidably attached to the top of the bell nipple 36 and sealed with a radial seal 37. It is contemplated that the containment member 12 may also be fixedly attached to the top of the docking station housing 10B, as is shown in other drawings, such as FIG. 6. The remotely actuated running tool 50 for insertion/removal of the RCD 14 mates with a radial groove 52 in the top of the RCD 14.

Figure 5:
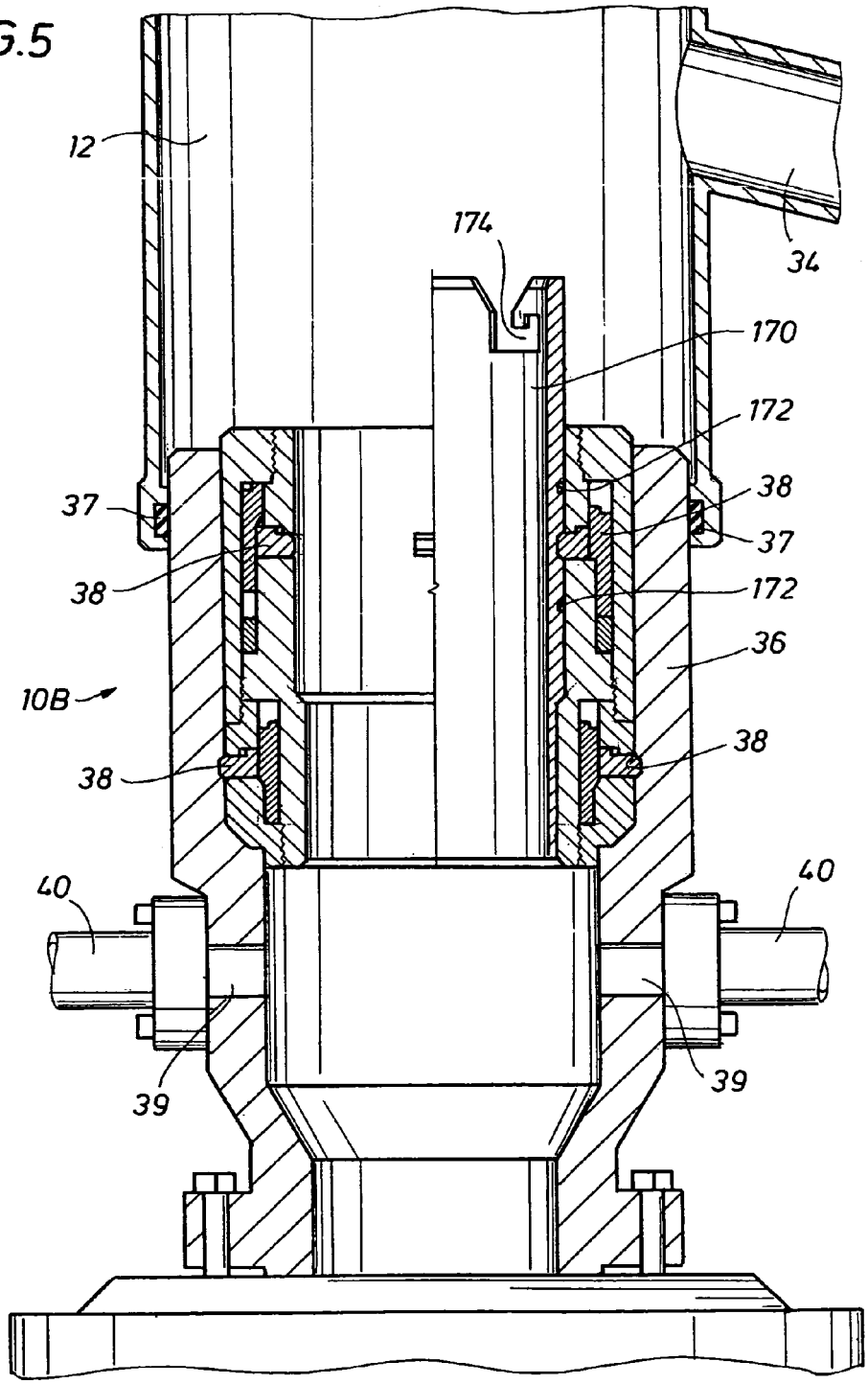
FIG. 5 is a elevational section view, similar to FIG. 4B, showing the RCD removed from the docking station housing for conventional drilling, and a split view showing a protective sleeve latched into the docking station housing on the right side of the vertical axis, and no sleeve on the left side.

For conventional hydrostatic pressure drilling operations, the RCD 14 is removed, as shown in FIG. 5, and the containment member outlet 34 is used for return drilling fluid coming up the annulus of the riser R. The outlet 34 could be twelve inches in diameter, although other diameters are contemplated. On the right side of the vertical axis, an optional protective pipe sleeve 170 is shown latched with the dual latching assembly 38 into the docking station housing 10B. The left side of the vertical axis shows the docking station housing 10B without a sleeve. The sleeve 170 has radial seals 172 to keep drilling fluid and debris from getting behind it during conventional drilling operations. The sleeve 170 protects the docking station housing 10B, including its surface, latches, sensors, ports, channels, seals, and other components, from impact with drill pipes and other equipment moved through the well center C. It is contemplated that the seals 172 could be ring seals or one-way wiper seals, although other seals are contemplated. It is contemplated that the protective sleeve 170 will be made of steel, although other materials are contemplated. The sleeve 170 could have one or more J-hook passive latching formations 174 for latching with a corresponding running tool 50 for insertion/removal. It is contemplated that other types of passive latching formations could be used in the sleeve 170, such as a groove (similar to groove 52 in RCD 14 in FIG. 14) or holes (FIG. 7C). It is contemplated that other types of running tools could be used for placement of the sleeve 170. It is also contemplated that installation of the sleeve 170 may selectively block the lubrication 58 and cooling (68, 69) channels (shown in FIG. 7A and discussed therewith) and/or trigger automatic recognition of sleeve 170 installation at the control panel. For example, installation of the sleeve 170 automatically shut off the lubrication and cooling systems of the docking station housing 10 while indicating these events on the control panel. Although the sleeve 170 is shown latched into a dual latching assembly 38, it is contemplated that the sleeve 170 could be latched into a single latching assembly 57 (FIG. 7C) and a J-hook latching assembly 90, 92 (FIG. 8) as well.

Turning to FIG. 6, a bell nipple 44 is attached to the top of an annular BOP 46. Rigid pipes 40 are shown for drilling fluid returns during managed pressure drilling or underbalanced drilling. Such rigid pipes 40 would typically only be used with a fixed drilling rig, similar to FIG. 2, otherwise flexible conduits are contemplated. The docking station housing 10A is fixedly attached to the bell nipple 44. A single hydraulic remotely activated latching mechanism 48, as described more fully in the '119 patent publication, latches the RCD 14 in place in the docking station housing 10A. As can now be understood, a dual latching assembly, such as assembly 38 in FIG. 4B, may not be necessary since the docking station housing 10A is mounted on top of a bell nipple or riser.

The RCD 14 comprises upper 17 and lower 15 passive stripper rubber seals. The running tool 50 inserts and removes the RCD 14 through the containment member 12. As will be described in detail when discussing FIG. 14, the running tool 50 mates with a groove 52 in the top of the RCD 14. It is contemplated that one or more fill lines 54 will be in the containment member 12. The fill lines 54 could be three inches in diameter, although other diameters are contemplated.

Figure 6A:
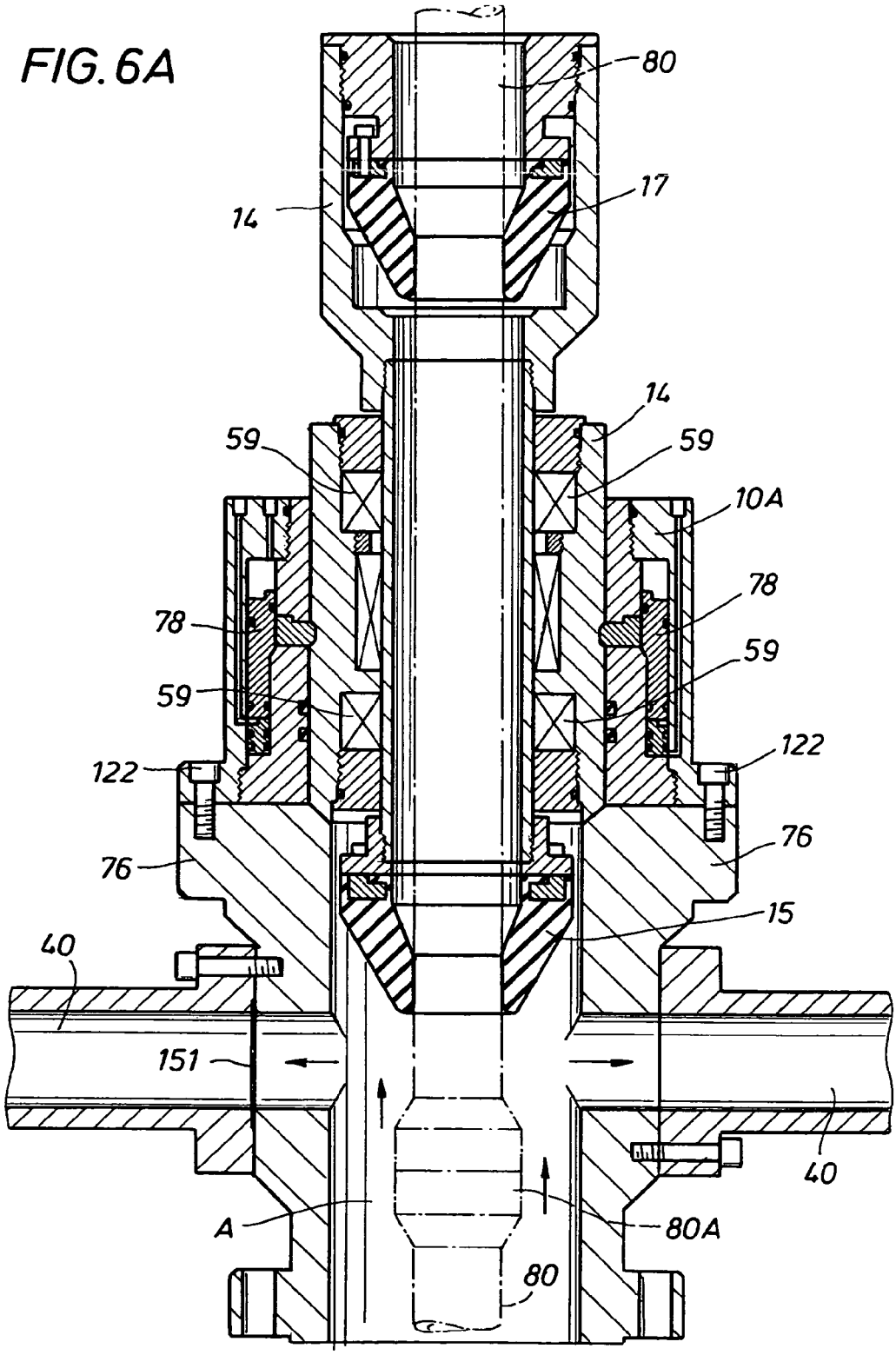
FIG. 6A is a section elevational view of a RCD latched into the docking station housing of the present invention, and a drill string shown in phantom view.

FIG. 6A shows a bell nipple 76 with rigid drilling fluid return lines 40 for use with a fixed drilling rig S (FIG. 2). The RCD 14 is again latched into the docking station housing 10A with a single latching assembly 78. The containment member 12 is not shown for clarity. The upper 17 and lower 15 stripper rubber seals of the RCD 14 are sealed upon a tubular 80 shown in phantom. The RCD 14, shown schematically, can be run in and out of the docking station housing 10A with the lower stripper rubber seal 15 resting on the top of pipe joint 80A.

Figure 7A:
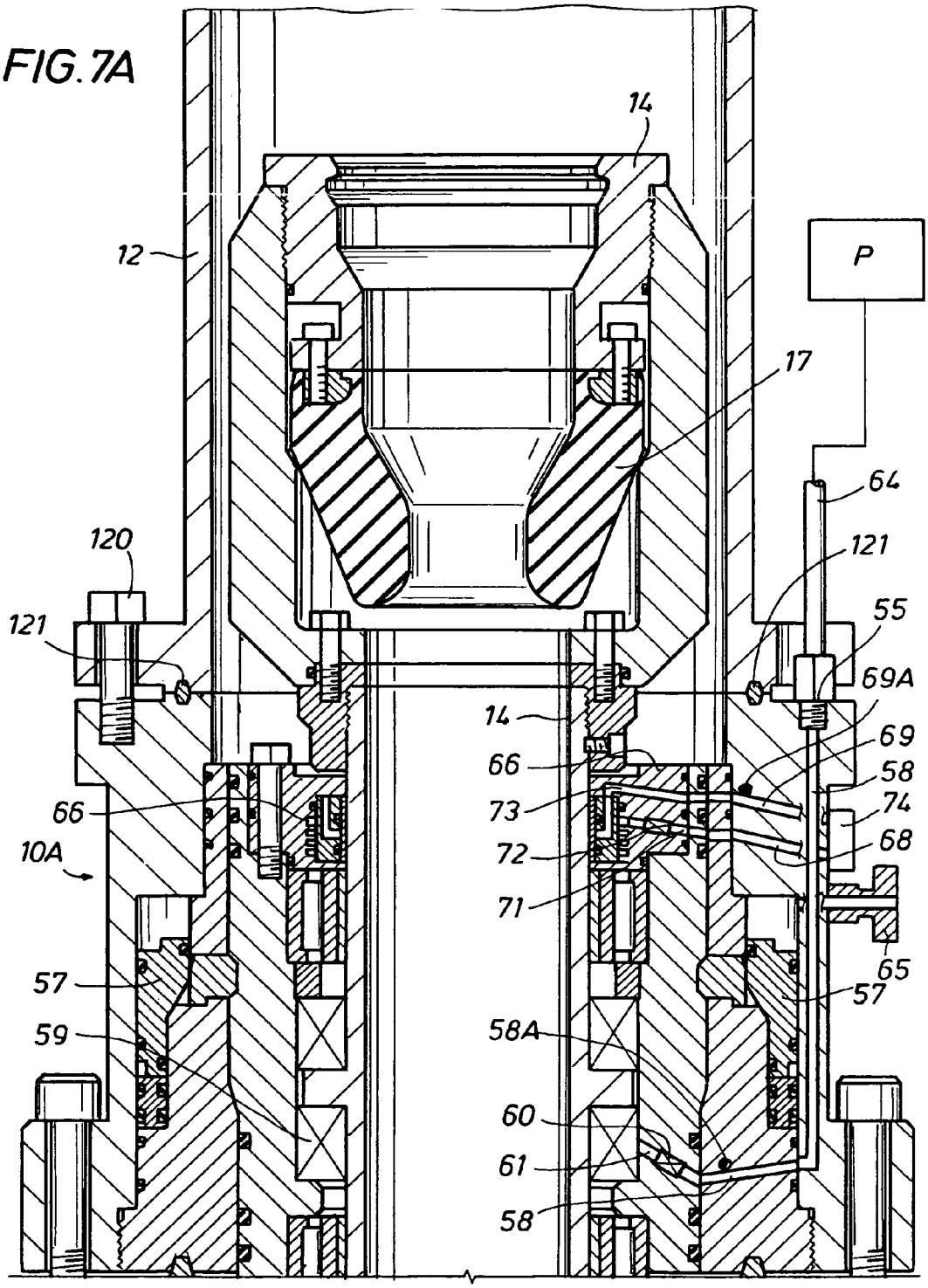
FIGS. 7A and 7B are section elevational detailed views of the docking station housing of the present invention, showing cooling and lubrication channels aligned with a latched RCD.
Figure 7B:
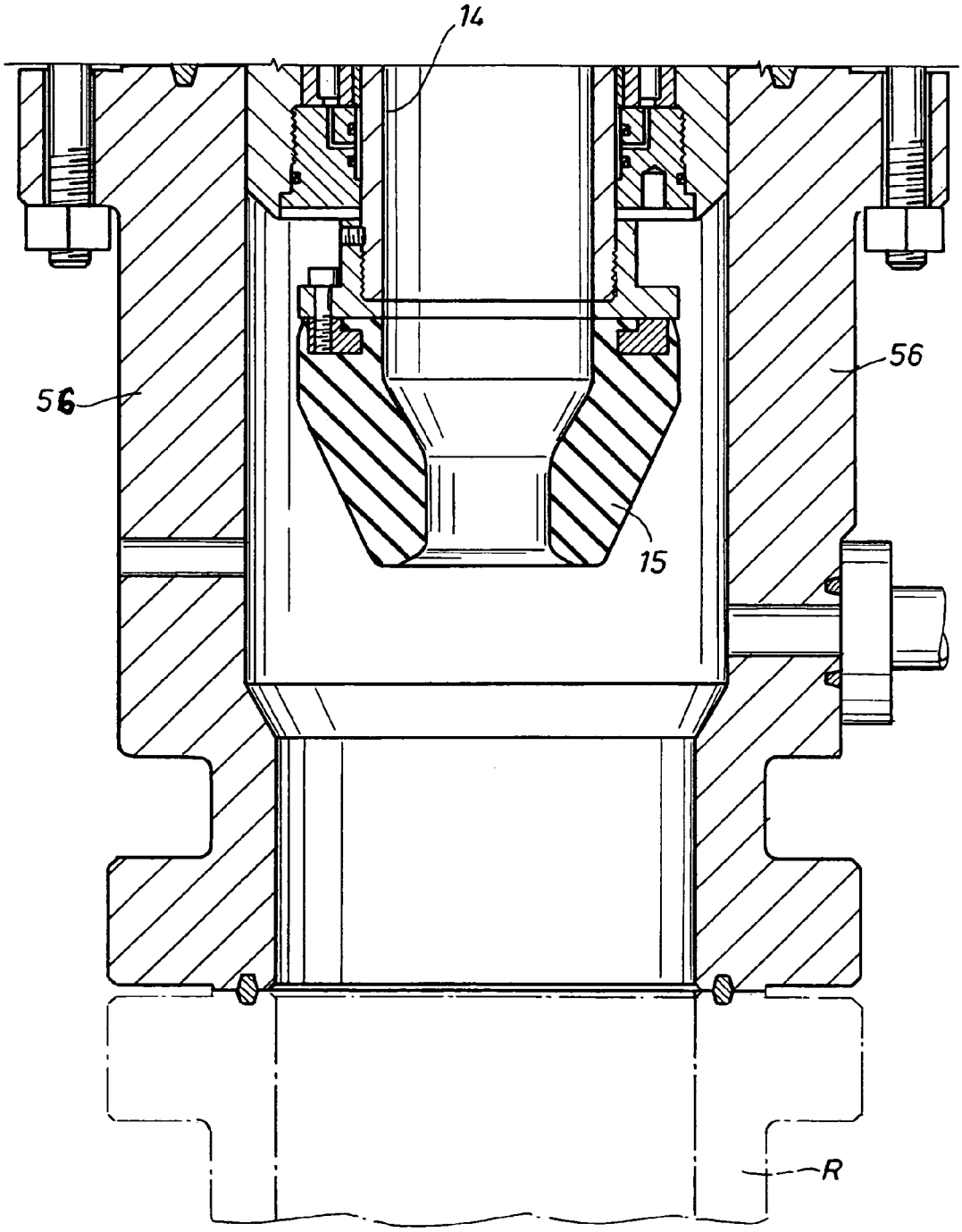
Figure 7C:
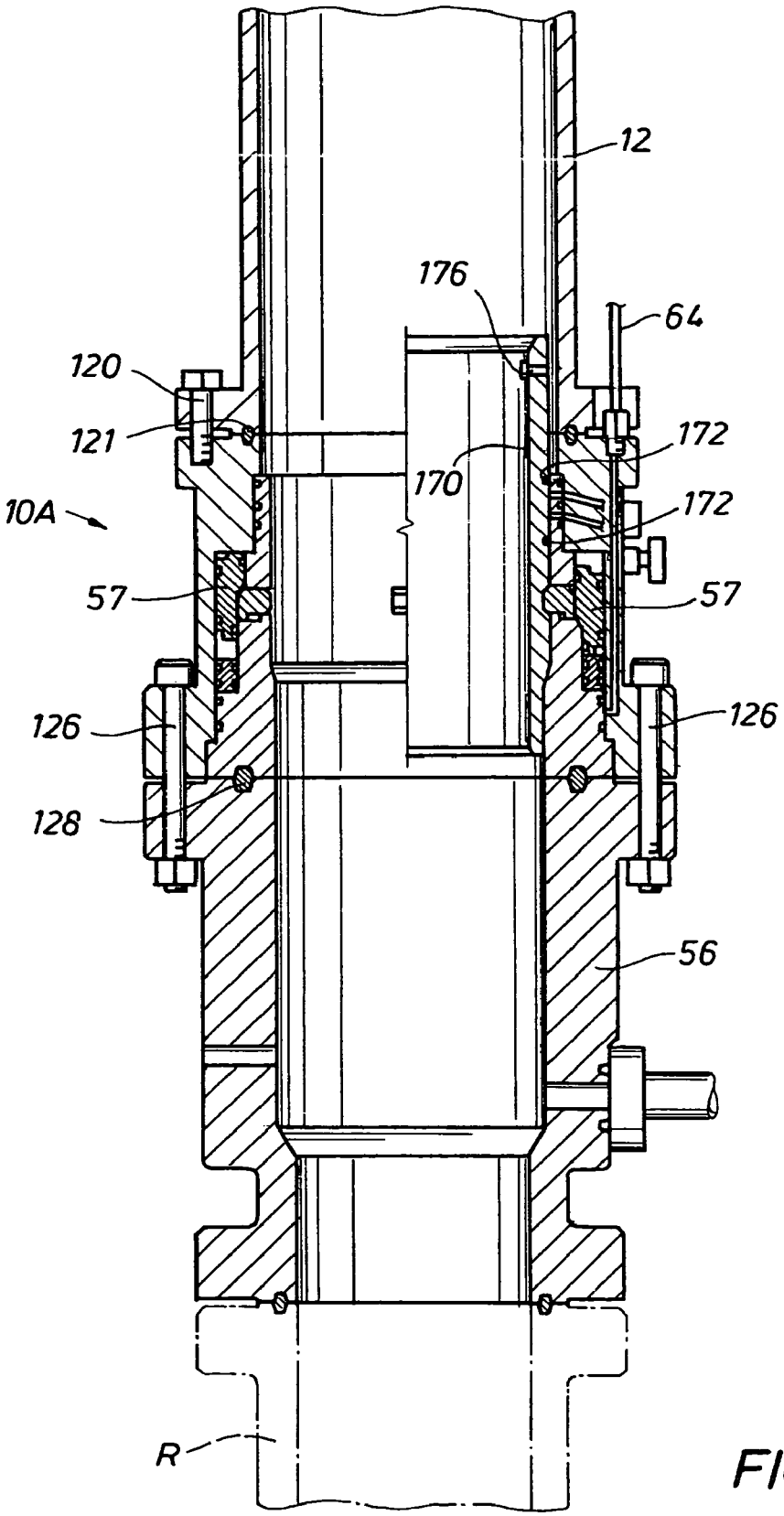
FIG. 7C is a section elevational detailed view of the docking station housing, showing the RCD removed from the docking station housing for conventional drilling, and a split view showing a protective sleeve latched into the docking station housing on the right side of the vertical axis, and no sleeve on the left side.
Figure 8:
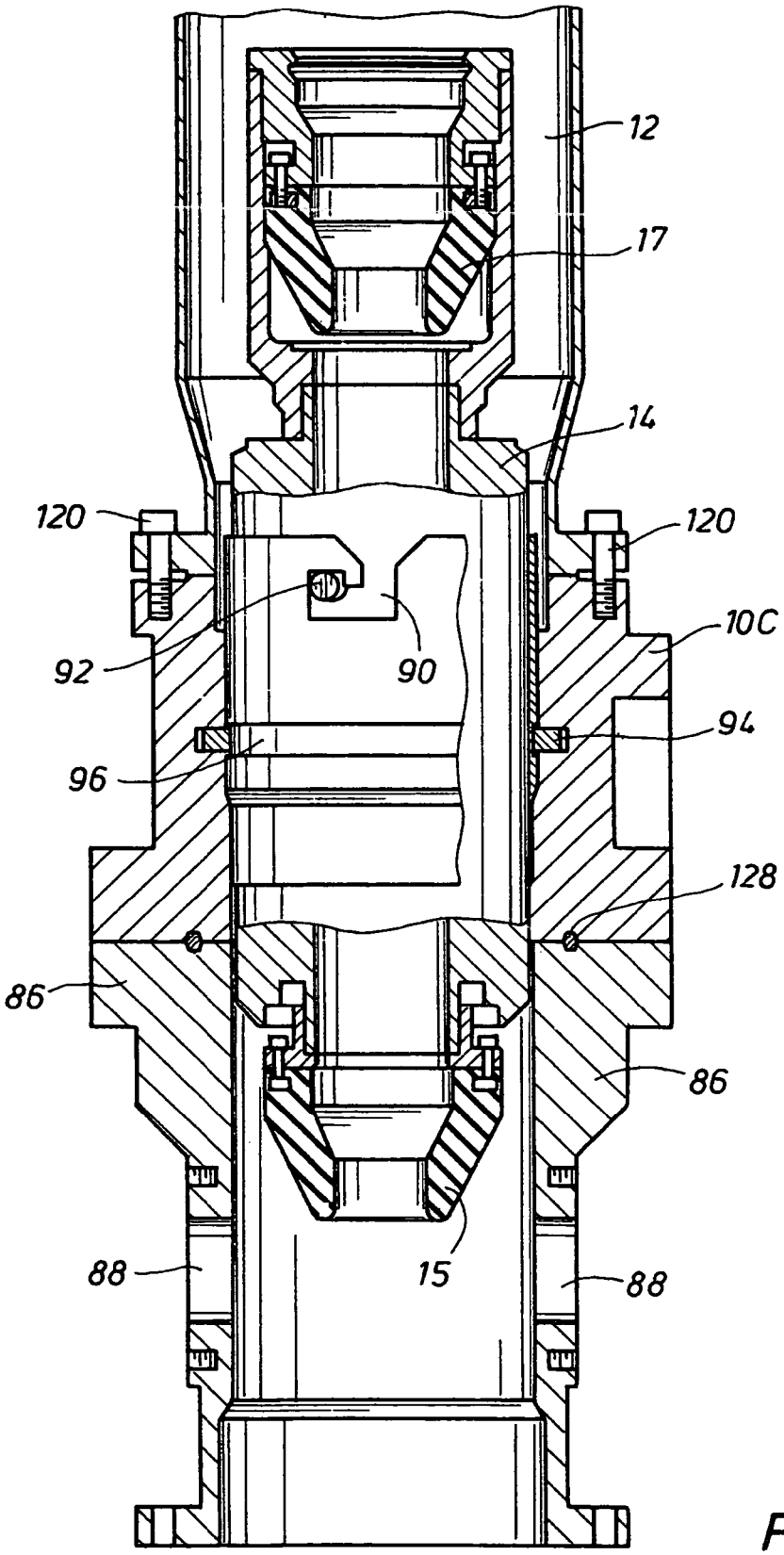
FIG. 8 is a elevational view in cut away section of a RCD latched into the docking station housing using an alternative latching embodiment, and the containment member.

FIGS. 7A and 7B show the docking station housing 10A with a single latching assembly 57. A RCD 14 with upper 17 and lower 15 stripper rubber seals is latched into the docking station housing 10A. The containment member 12 is bolted with bolts 120 and sealed with a seal 121 to the top of the docking station housing 10A. Other methods of sealing and attaching the containment member 12 to the docking station housing 10A known in the art are contemplated. The RCD 14 shown in FIG. 7A is similar to the Weatherford-Williams Model 7900 RCD available from Weatherford International, Inc. of Houston, Tex., which is not a self-lubricating RCD.

Turning to FIG. 7A, a conduit 64 from the lubricant reservoir (not shown) connects with the docking station lubrication channel 58 at a lubrication port 55. The docking station lubrication channel 58 in the docking station housing 10A allows for the transfer of lubricant, such as oil, to the bearing assembly 59 of the RCD 14. Upon proper insertion and latching of the RCD 14 in the docking station housing 10A, the docking station lubrication channel 58 is aligned with the corresponding RCD lubrication channel 61. Although one channel is shown, it is contemplated that there could be more than one channel. A lubrication valve 60 in the RCD 14 can control the flow of lubricant to the RCD bearings 59. At least one sensor 58A, for example an electrical, mechanical, or hydraulic sensor, may be positioned in the docking station housing 10A to detect whether the RCD 14 needs lubrication, in which case a signal could be sent to activate the lubricant pump P to begin the flow of lubricant. It is contemplated that the sensor or sensors could be mechanical, electrical, or hydraulic.

It is contemplated that the one or more other sensors or detection devices could detect if (1) the RCD 14 or other devices, as discussed below, latched into the docking station housing 10A have rotating seals or not, and, if rotating, at what revolutions per minute "RPM", (2) the RCD 14 or other latched device was rotating or not, or had capability to rotate, and/or (3) the RCD 14 was self-lubricating or had an internal cooling system. It is contemplated that such detection device or sensor could be positioned in the docking station housing 10A for measuring temperature, pressure, density, and/or fluid levels, and/or if lubrication or cooling was necessary due to operating conditions or other reasons. It is contemplated that there could be continuous lubrication and/or cooling with an interactive increase or decrease of fluids responsive to RPM circulation rates. It is contemplated that there could be measurement of the difference in pressure or temperature within different sections, areas, or components of the latched RCD 14 to monitor whether there was leakage of a seal or some other component. If the RCD is self-lubricating, such as the Weatherford-Williams Model 7875 RCD available from Weatherford International, Inc. of Houston, Tex., then the pump P would not be actuated, unless lubrication was needed to top-up the RCD 14 lubrication system. It is contemplated that the RCD 14 lubrication and/or cooling systems may have to be topped-up with fluid if there is some internal leakage or bleed through the RCD rotating seal, and the sensor would detect such need. The lubrication controls can be operated manually, automatically, or interactively.

In different configurations of bell nipples, such as with a taller wall height as shown in FIG. 5, it is contemplated that the docking station lubrication channel 58 would also extend through the walls of the bell nipple. A manual valve 65 can also be used to commence and/or interrupt lubricant flow. It is contemplated that the valve 65 could also be remotely operable. Check valves (not shown), or other similar valves known in the art, could be used to prevent drilling fluid and debris from flowing into the docking station lubrication channel 58 when the RCD 14 is removed for conventional drilling. It is contemplated that the lines could be flushed when converting back from conventional drilling to remove solidified drilling fluid or mud and debris. This would be done before the protective sleeve 170 would be installed. Also, the protective sleeve 170 would prevent damage to sealing surfaces, latches, sensors and channel 58 from impact by drill pipes and other equipment moved through the well center C.

If the RCD 14 has a cooling system 66, such as proposed in Pub. No. U.S. 2006/0144622, the docking station housing 10A provides cooling fluid, such as gas or liquid, to the RCD 14. Several different cooling system embodiments are proposed in the '622 patent publication. While the external hydraulic lines and valves to operate the cooling system are not shown in FIG. 7A, docking station cooling inlet channel 68 and outlet channel 69 in the docking station housing 10A allow for the transport of fluid to the RCD 14. Upon proper insertion and latching of the RCD 14 in the docking station housing 10A, the docking station cooling inlet channel 68 and outlet channel 69 are aligned with their corresponding cooling channels 71, 73, respectively, in the RCD 14. It is contemplated that the channels and valves would automatically open and/or close upon the latching or unlatching of the RCD 14. It is also contemplated that the channels (60, 69, 71, 73) and valves, including valve 72, could be opened or closed manually. It is contemplated that there may be more than one cooling channel. It should be understood that docking station cooling channels 68, 69 may extend into the bell nipple 56, if necessary. Likewise, it is contemplated that the bell nipple 36 in FIG. 5 would have one or more of such cooling channels extending through it due to its taller walls. Returning to FIG. 7A, a cooling port 74 provides for the attachment of external cooling lines 111 (shown in FIG. 10). A valve 72 in the RCD inlet cooling channel 71 can control flow into the RCD 14.

A sensor 69A (FIG. 7A) in the docking station housing 10A remotely senses the fluid temperature in the outlet channel 69 and signals the operator or CPU operating system to actuate the hydraulic controls (not shown) accordingly. It is contemplated that the sensor could be mechanical, electrical, or hydraulic. Alternatively, the controls for the cooling can be operated manually or automatically. It is contemplated that the CPU operating system could be programmed with a baseline coolant temperature that can control the flow of coolant to the RCD 14. Check valves, or other similar valves known in the art, could be used to prevent drilling fluid and debris from flowing into the docking station cooling channels 68, 69 when the RCD 14 is removed for conventional drilling. It is contemplated that the lines could be flushed of drilling fluid and debris when converted back from conventional drilling. This would be done before installation of the protective sleeve 170. Also, the protective sleeve 170 would prevent drilling fluid and debris from flowing into the docking station cooling channels 68, 69 when the RCD 14 is removed for conventional drilling. It would also prevent damage to the sensors, latches, ports, surfaces, and channels 68, 69 from impact by drill pipes and other equipment moved through the well center C.

FIG. 7C is similar to FIGS. 7A and 7B, except that the RCD 14 is shown removed for conventional drilling. A bell nipple 56 is shown mounted to the upper section of a marine riser R. The docking station housing 10A is bolted by bolts 126 and sealed with seals 128 with the top of the bell nipple 56, and the containment member 12 is attached to the top of the docking station housing 10 using bolts similar to bolt 120. Other methods and systems of sealing and attachment are contemplated. The single latching assembly 57 is illustrated disengaged on the left side of the vertical axis since the RCD 14 has been removed. The details of the docking station housing 10A are more clearly shown in FIG. 7A. Since the docking station housing 10A is mounted to the top of the bell nipple 56, only a single latching assembly 57 is used. The protective sleeve 170 is shown latched with single latching assembly 57 and radially sealed 172 into the docking station housing 10A on the right side of the vertical axis. The sleeve 170 is optional, and is shown removed on the left side of the vertical axis in an alternative embodiment. The sleeve 170 has passive holes 176 for insertion and removal with a running tool 50, although other passive latching formations, such as a groove (FIG. 14) or J-hook formation (FIG. 5) are contemplated.

FIG. 8 shows an alternative embodiment for latching or J-hooking the RCD 14 into the docking station housing 10C. One or more passive latching members 92 on the RCD 14 latches or J-hooks with the corresponding number of similarly positioned passive latching formations 90 in the interior of the docking station housing 10C. A radial ring 94 in the docking station housing 10C engages and grips the RCD 14 in a radial groove 96 on the exterior of its housing. The docking station housing 10C is shown mounted on a bell nipple 86 which has two openings 88 for return mud flow.

Figure 9:
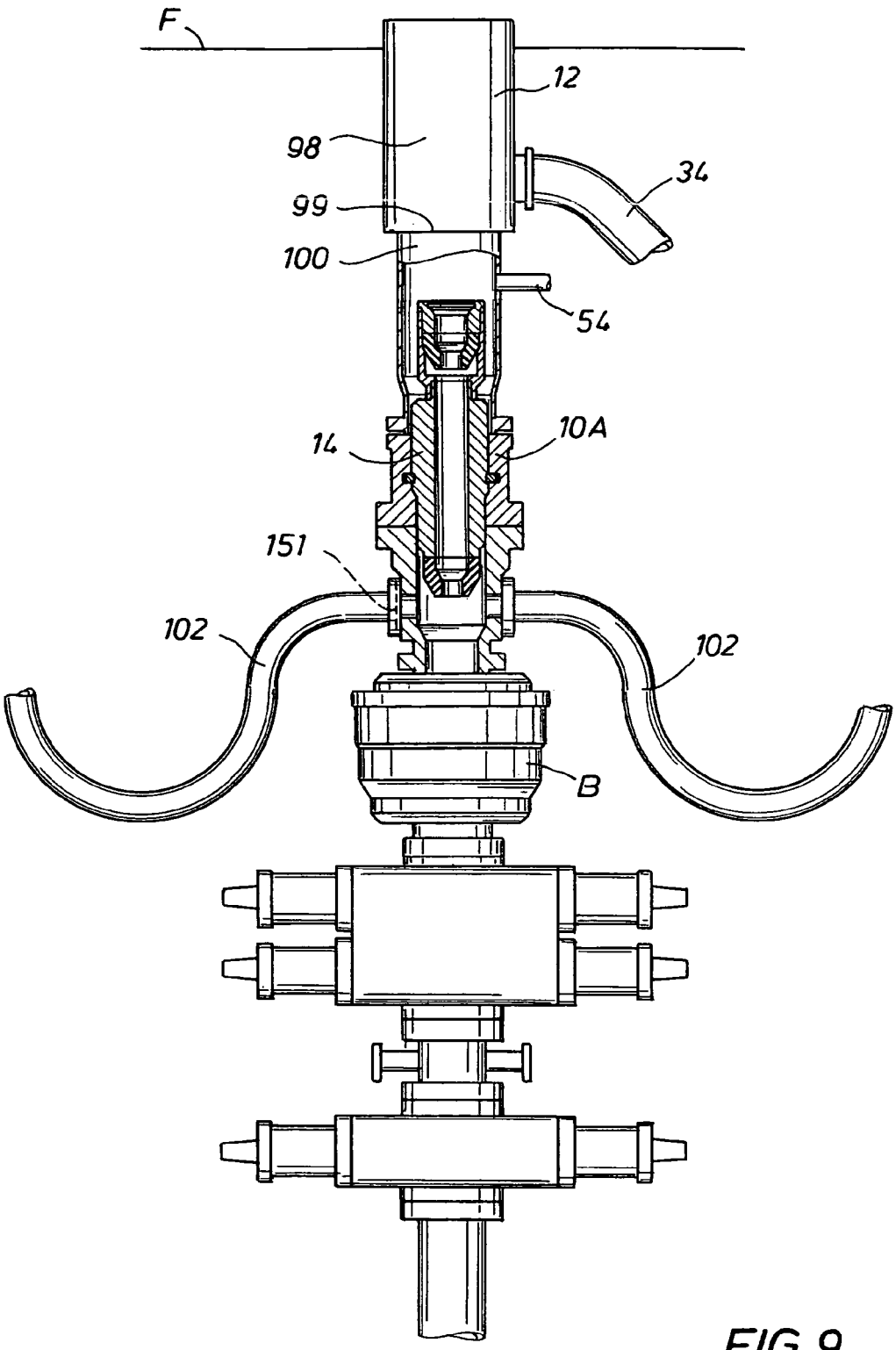
FIG. 9 is a elevational view with a cut away section of a RCD latched into the docking station housing of the present invention using a single latching assembly, and the telescoping or slip joint used with the containment member.

Turning to FIG. 9, a RCD 14 is latched into the docking station housing 10A. While the flexible drilling fluid return lines 102 are necessary for use with a floating drilling rig S, they can also be used with fixed drilling rigs. It is contemplated that one of openings for the lines could be covered with a rupture disc 151, which is shown in phantom. The containment member 12 has a docking station housing telescoping or slip joint 99 with inner barrel 100 and outer barrel 98. The outer barrel 98 of the containment vessel 12 is shown schematically attached to the underside of the drilling floor F. The docking station housing slip joint 99 compensates for vertical movement with a floating drilling rig S such as shown in FIG. 1. It is also contemplated that the slip joint 99 can be used with a fixed drilling rig S, such as shown in FIG. 2. The location of the docking station housing slip joint 99 above the surface of the water allows for the pressure containment capability of docking station housing joint 99 to be relatively low, such as for example 5 to 10 psi. Although a docking station housing slip joint 99 is shown, other types of joints or pipe that will accommodate relative vertical movement are contemplated. Riser slip joints used in the past, such as shown in FIG. 1 of U.S. Pat. No. 6,913,092 B2, have been located below the diverter. Such riser slip joints must have a much higher allowable containment pressure when locked down and pressurized, such as for example 500 psi. Further, the seals for such riser slip joints must be frequently replaced at significant cost. An existing riser slip joint could be locked down if the docking station housing joint 99 in the containment member 12 were used. It is contemplated in an alternate embodiment, that a containment member 12 without a docking station housing joint 99 could be used with a floating drilling rig. In such alternate embodiment, a riser telescoping or slip joint SJ could be located above the water, but below the docking station housing 10, such as the location shown in FIG. 1.

Figure 10:
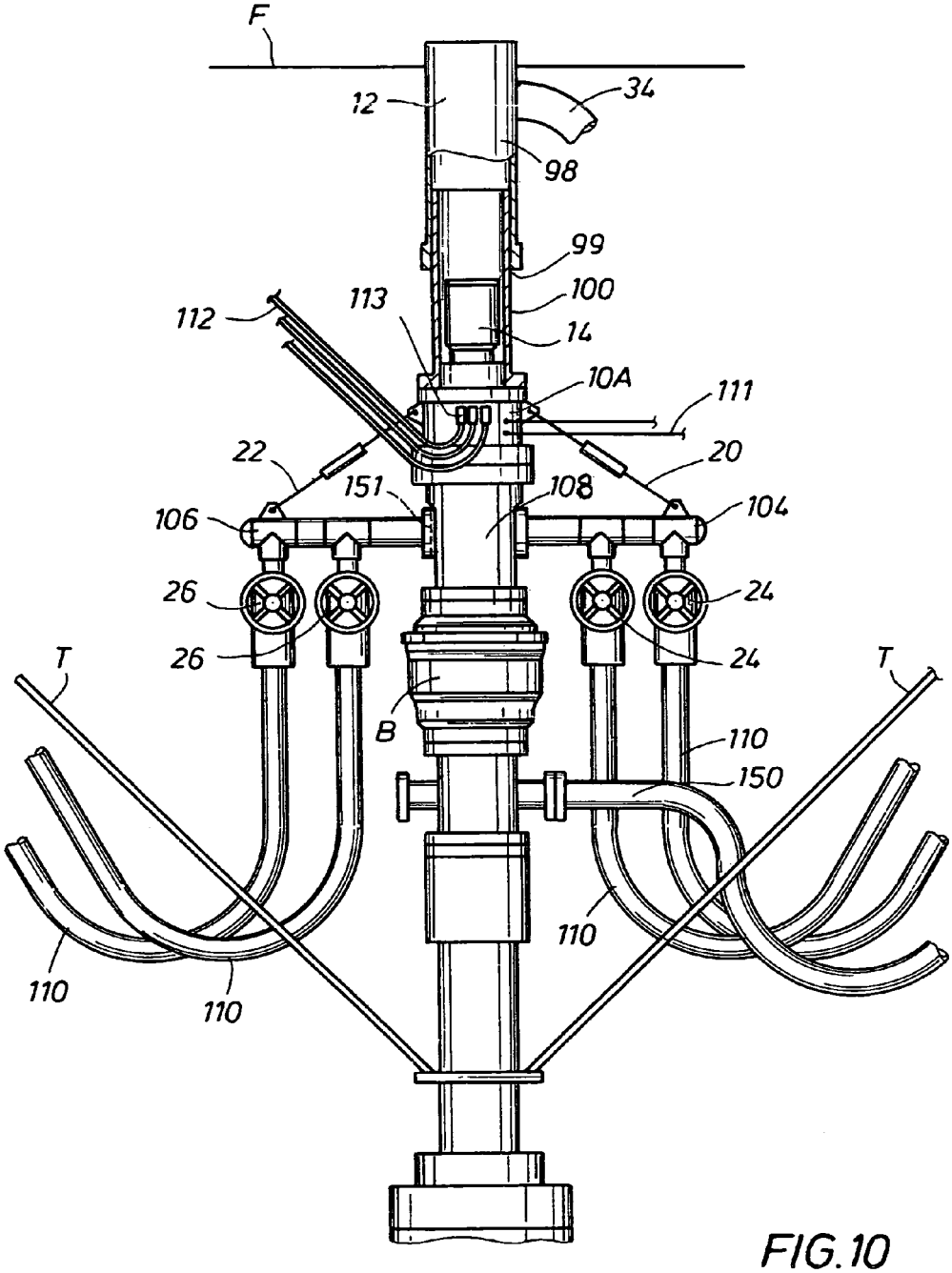
FIG. 10 is a elevational view of an annular BOP, flexible conduits, the docking station housing of the present invention, and, in cut away section, the telescoping or slip joint used with the containment member.

FIG. 10 shows an embodiment of the present invention that is similar to FIG. 3A. Two T-connectors (104, 106) attached to two openings in the bell nipple 108 allow drilling fluid returns to flow through flexible conduits 110 as would be desirable for a floating drilling rig S. It is contemplated that a rupture disc 151 be placed over one opening. Manual valves (24, 26) are shown, although it is contemplated that remotely operated valves could also be used, as shown in FIG. 3A. It is further contemplated that relief valves could advantageously be used and preset to different pressure settings, such as for example 75 psi, 100 psi, 125 psi, and 150 psi. It is also contemplated that one or more rupture discs with different pressure settings could be used. It is also contemplated that one or more choke valves could be used for different pressure settings. It is contemplated that conduit 150 could be a choke/kill line for heavy mud or drilling fluid. A docking station housing joint 99 in the containment member 12 is used with a floating drilling rig S. An outlet 34 in the containment member 12 provides for return drilling fluid in conventional drilling. External hydraulic lines 112 connect to hydraulic ports 113 in the docking station housing 10A for operation of the latching assembly. External cooling lines 111 connect to the docking station housing 10A for operation of the RCD 14 cooling system.

Figure 11:
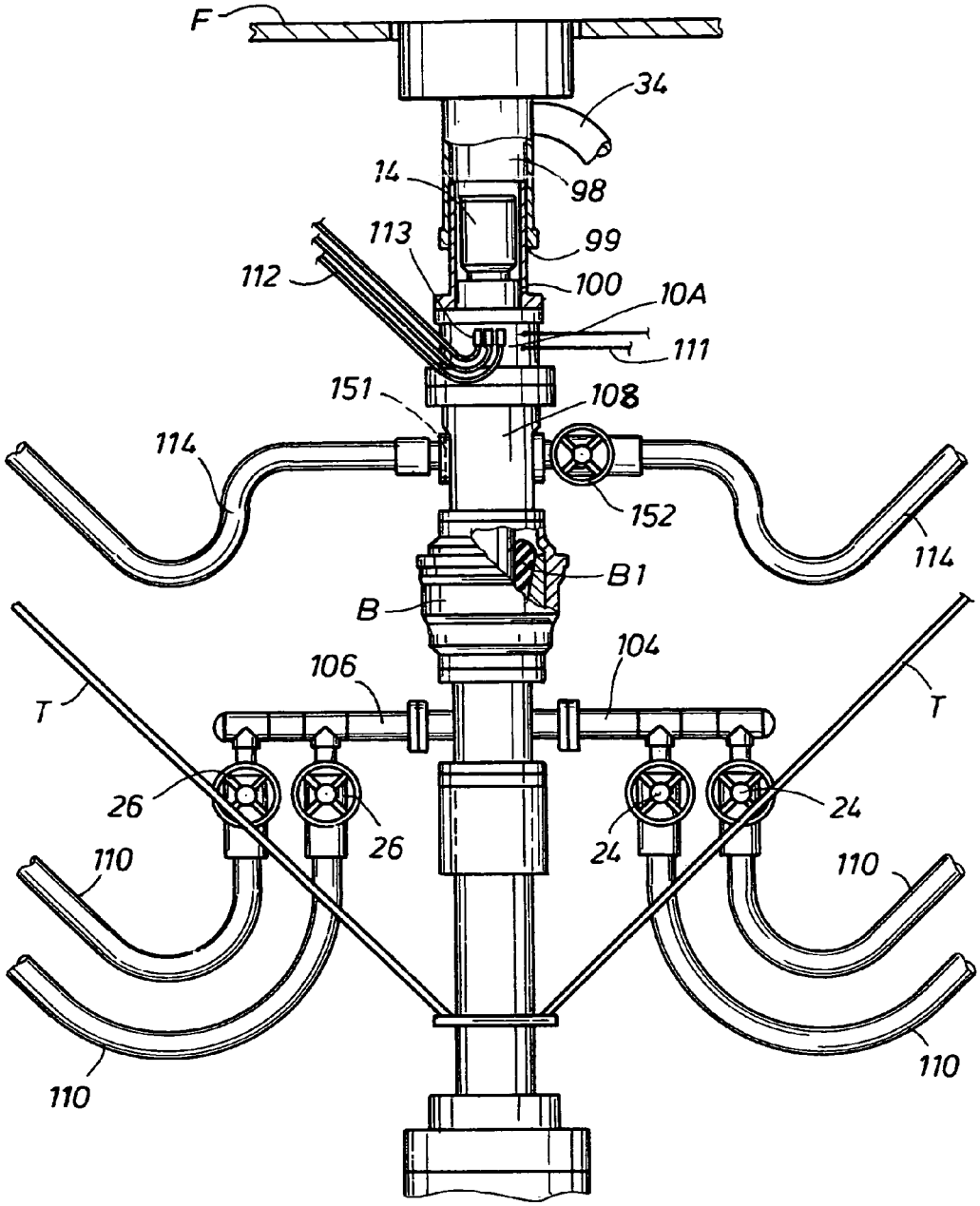
FIG. 11 is an elevational view similar to FIG. 10, but with the position of the flexible conduits above and below the annular BOP reversed along with a cut away section view of the annular BOP.

FIG. 11 shows an alternative embodiment to FIG. 10 of the present invention, with different configurations of the T-connectors (104, 106), flexible conduit (110, 114) and annular BOP B. It is contemplated that a rupture disc 151, shown in phantom, could be used to cover one of the openings in the bell nipple 108 leading to the conduits 114. It is contemplated that a preset pressure valve 152 could be used for the other opening in the bell nipple 108 leading to the conduit 114 for use when the annular seal B1 of the BOP B is closed, decreasing the area between the seal B1 and the RCD 14, thereby increasing the pressure there between. Likewise, it is contemplated that a rupture disk would be used to cover one of the openings leading to the T-connectors (104, 106). It is also contemplated that relief valves could be used instead of manual valves (24, 26) and preset to different pressure settings, such as for example 75 psi, 100 psi, 125 psi, and 150 psi. It is contemplated that one or more rupture discs could be used for different pressure settings. It is contemplated that one or more of the lines 110 could be choke or kill lines. It is contemplated that one or more of the valves (24, 26) would be closed. The docking station housing joint 99 in the containment member 12 and the flexible conduit (110, 114) are necessary for floating drilling structures S and compensate for the vertical movement of the floor F and lower floor LF on the drilling rig S. It is contemplated that tension support members or straps (20, 22), as shown in FIG. 10, could be used to support the T-connectors (104, 106) in FIG. 11.

Figure 12:
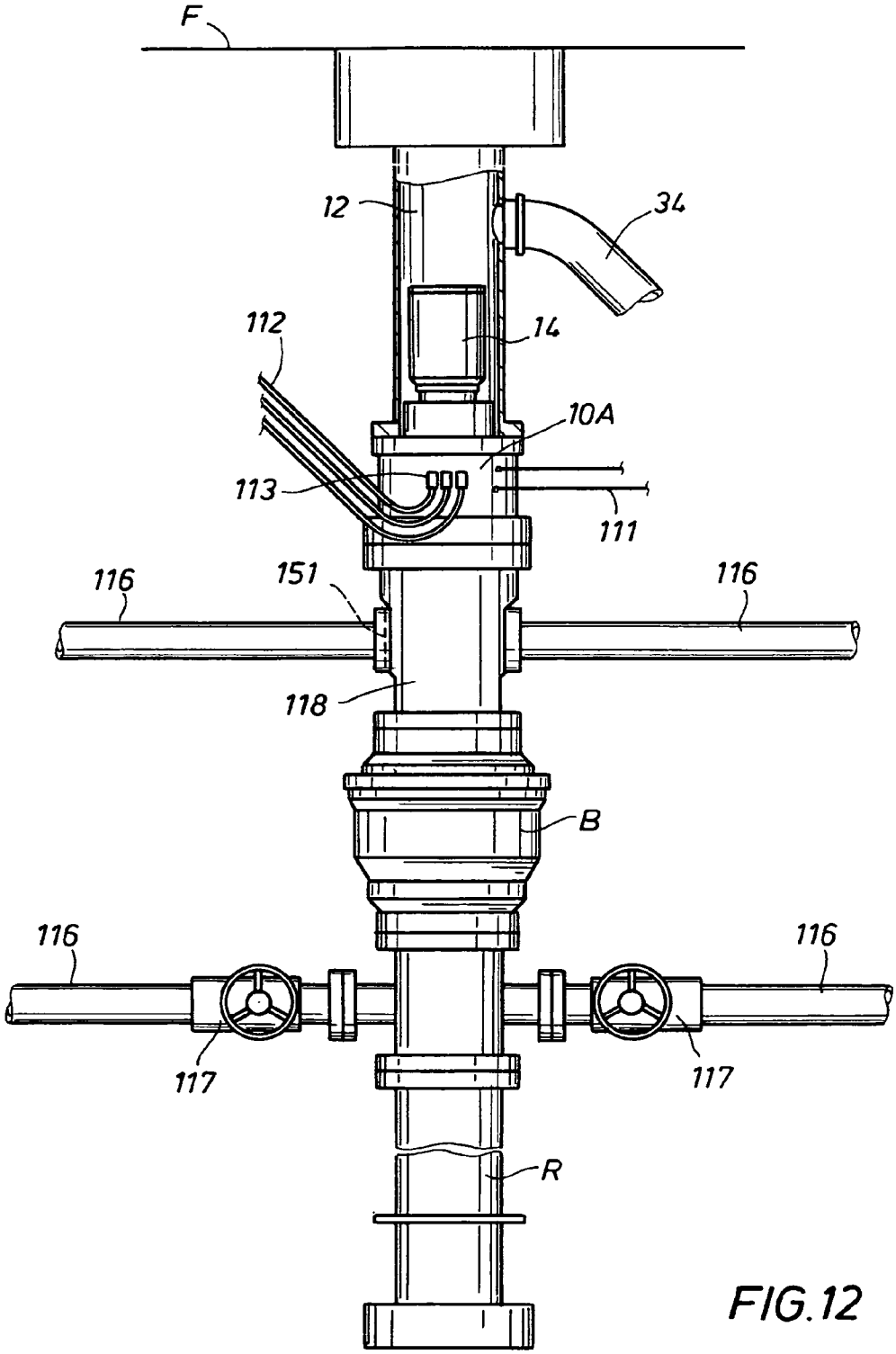
FIG. 12 is a elevational view of an annular BOP, rigid piping for drilling fluid returns for use with a fixed rig, a RCD latched into the docking station housing, and, in cut away section, the containment member with no telescoping or slip joint.
Figure 13:
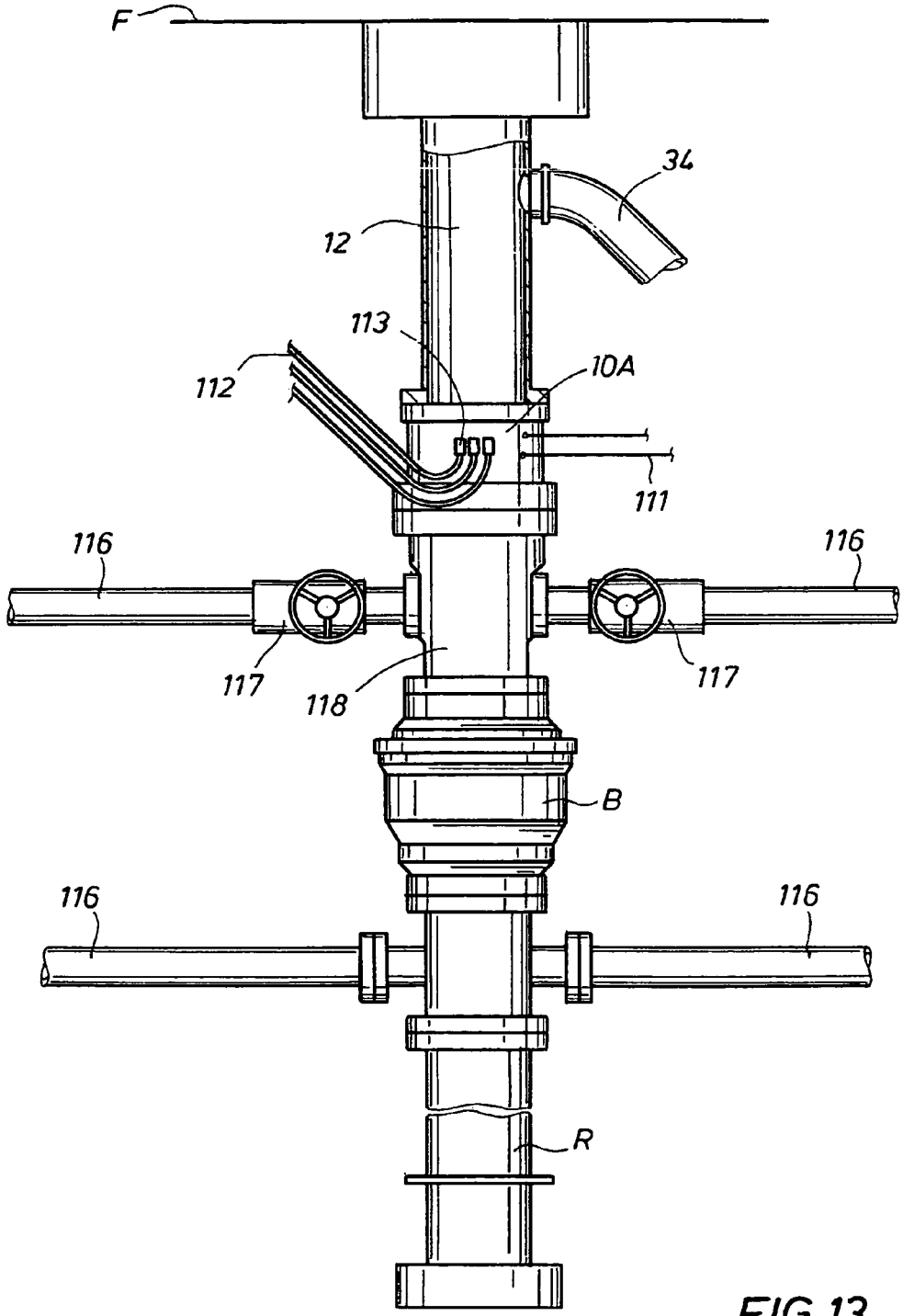
FIG. 13 is similar to FIG. 12, except that the RCD has been removed and the drilling fluid return line valves are reversed.

Turning to FIGS. 12 and 13, an RCD 14 is latched into the docking station housing 10A in FIG. 12, but has been removed in FIG. 13. The containment member 12 does not have a docking station housing slip joint 99 in this fixed drilling rig S application. However, a docking station housing slip joint 99 could be used to enable the drilling assembly to be moved and installed from location to location and from rig to rig while compensating for different ocean floor conditions (uneven and/or sloping) and elevations. Likewise, the drilling fluid return pipes 116 are rigid for a fixed drilling rig application. A conduit would be attached to outlet 34 for use in conventional drilling. The docking station housing 10A is mounted on top of a bell nipple 118, and therefore has a single latching assembly 78. It is contemplated that a rupture disc 151, shown in phantom, be placed over one of the openings in the bell nipple 118 leading to the drilling fluid return pipe 116. Manual, remote or automatic valves 117 can be used to control the flow of fluid above and/or below the annular BOP B.

Figure 14:
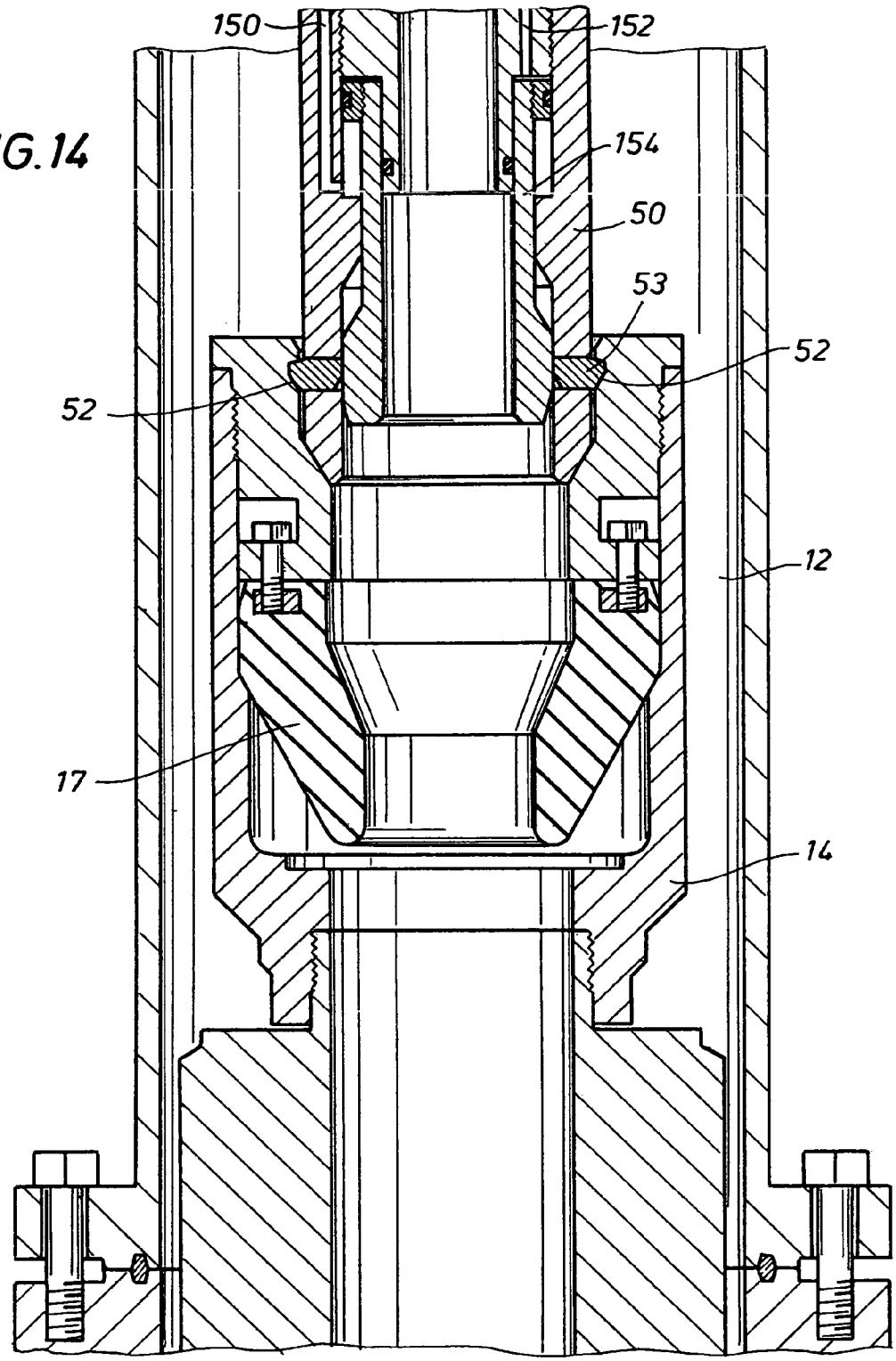
FIG. 14 is an enlarged section elevation view of the remotely actuated hydraulic running tool as shown in FIG. 6 latched with the RCD for installation/removal with the RCD docking station housing of the present invention.

Turning to FIG. 14, the running tool 50 installs and removes the RCD 14 into and out of the docking station housing 10 through the containment member 12 and well center C. A radial latch 53, such as a C-ring, a plurality of lugs, retainers, or another attachment apparatus or method that is known in the art, on the lower end of the running tool 50 mates with a radial groove 52 in the upper section of the RCD 14.

As can now be seen in FIG. 14, when hydraulic fluid is provided in channel 150, the piston 154 is moved up so that the latch 53 can be moved inwardly to disconnect the running tool 50 from the RCD 14. When the hydraulic fluid is released from channel 150 and hydraulic fluid is provided in channel 152 the piston 154 is moved downwardly to move the latch 53 outwardly to connect the tool 50 with the RCD 14. A plurality of dogs (not shown) or other latch members could be used in place of the latch 53.

As discussed above, it is contemplated that all embodiments of the docking station housing 10 of the present invention can receive and hold other oilfield devices and equipment besides an RCD 14, such as for example, a snubbing adaptor, a wireline lubricator, a test plug, a drilling nipple, a non-rotating stripper, or a casing stripper. Again, sensors can be positioned in the docking station housing 10 to detect what type of oilfield equipment is installed, to receive data from the equipment, and/or to signal supply fluid for activation of the equipment.

It is contemplated that the docking station housing 10 can interchangeably hold an RCD 14 with any type or combination of seals, such as dual stripper rubber seals (15 and 17), single stripper rubber seals (15 or 17), single stripper rubber seal (15 or 17) with an active seal, and active seals. Even though FIGS. 1-14 each show one type of RCD 14 with a particular seal or seals, other types of RCDs and seals are contemplated for interchangeable use for every embodiment of the present invention.

It is contemplated that the three different types of latching assemblies (as shown with a docking station housing 10A, 10B, and 10C) can be used interchangeably. Even though FIGS. 1-14 each show one type of latching mechanism, other types of latching mechanisms are contemplated for every embodiment of the present invention.

Method of Use

Converting an offshore or land drilling rig or structure between conventional hydrostatic pressure drilling and managed pressure drilling or underbalanced drilling uses the docking station housing 10 of the present invention. The docking station housing 10 contains either a single latching assembly 78 (FIG. 6A), a dual latching assembly 38 (FIG. 4B), or a J-hooking assembly 90, 92 (FIG. 8). As shown in FIG. 7C, docking station housing 10A with a single latching assembly 57 is fixedly mounted, typically with bolts 126 and a radial seal 128, to the top of the bell nipple 56. As shown in FIG. 4B, docking station housing 10B with a dual latching assembly 38 is bolted into the upper section of annular BOP B.

If the docking station housing 10 is used with a floating drilling rig, then the drilling fluid return lines are converted to flexible conduit such as conduit 102 in FIG. 9. If a fixed drilling rig is to be used, then the drilling return lines may be rigid such as piping 40 in FIG. 6A, or flexible conduit could be used. As best shown in FIGS. 7A, 10, and 11, the hydraulic lines 112, cooling lines 111, and lubrication lines 64 are aligned with and connected to the corresponding ports (113, 74, and 55) in the docking station housing 10. If a fixed drilling rig S is to be used, then a containment member 12 without a docking station housing slip joint 99 can be selected. However, the fixed drilling rig S can have a docking station housing slip joint 99 in the containment member 12, if desired. If a floating drilling rig S is to be used, then a docking station housing slip joint 99 in the containment member 12 may be preferred, unless a slip joint is located elsewhere on the riser R.

As shown in FIG. 7A, the bottom of the containment member 12 can be fixedly connected and sealed to the top of the docking station housing 10, typically with bolts 120 and a radial seal 121. Alternatively, the containment member 12 is slidably attached with the docking station housing 10 or the bell nipple 36, depending on the configuration, such as shown in FIGS. 4A and 4B, respectively. Although bolting is shown, other typical connection methods that are known in the art, such as welding, are contemplated. Turning to FIG. 9, if a docking station housing slip joint 99 is used with the containment member 12, then the seal, such as seal 37 shown in FIGS. 4B and 5, between the inner barrel 100 and outer barrel 98 is used.

As shown in FIG. 4A, the top of the containment member 12 can be fixedly attached to the bottom of the drilling rig or structure S or drilling deck or floor F so that drilling fluid can be contained while it flows up the annular space during conventional drilling using the containment member outlet 34. The running tool 50, as shown in FIG. 14, is used to lower the RCD 14 into the docking station housing 10, where the RCD 14 is remotely latched into place. The drill string tubulars 80, as shown in phantom in FIG. 6A, can then be run through well center C and the RCD 14 for drilling or other operations. The RCD upper and lower stripper rubber seals (15, 17) shown in FIG. 6A rotate with the tubulars 80 and allow the tubulars to slide through, and seal the annular space A as is known in the art so that drilling fluid returns (shown with arrows in FIG. 6A) will be directed through the conduits or pipes 40 as shown. It is contemplated that a rupture disc 151 could cover one of the two openings in the bell nipple 76 shown in FIG. 6A. Alternatively, as discussed above, it is contemplated that a plurality of pre-set pressure valves could be used that would open if the pressure reached their respective pre-set levels. As described above in the discussion of FIGS. 10 to 13, preset pressure valves or rupture disks could be installed in the drilling fluid return lines, and/or some of the lines could be capped or used as choke or kill lines.

If the RCD 14 is self-lubricating, then the docking station housing 10 could be configured to detect this and no lubrication will be delivered. However, even a self-lubricating RCD 14 may require top-up lubrication, which can be provided. If the RCD 14 does require lubrication, then lubrication will be delivered through the docking station housing 10. If the RCD 14 has a cooling system 66, then the docking station housing 10 could be configured to detect this and will deliver gas or liquid. Alternatively, the lubrication and cooling systems of the docking station housing 10 can be manually or remotely operated. It is also contemplated that the lubrication and cooling systems could be automatic with or without manual overrides.

When converting from managed pressure drilling or underbalanced drilling to conventional hydrostatic pressure drilling, the remotely operated hydraulic latching assembly, such as assembly 78 in FIG. 6A, is unlatched from the RCD 14. The running tool 50, shown in FIG. 14, is inserted through the well center C and the containment member 12 to connect and lift the RCD 14 out of the docking station housing 10 through the well center C. FIG. 4B shows the docking station housing 10 with the RCD 14 latched and then removed in FIG. 5. The drilling fluid returns piping such as 40 in FIG. 6A would be capped. Valves such as 24, 26, 152 in FIG. 11 would be closed. The outlet 34 of the containment member 12 as shown in FIG. 12 would provide for conventional drilling fluid returns. Fluid through the external hydraulic 112, cooling 111, and lubrication 64 lines and their respective ports (113, 74, 55) on the docking station housing 10 would be closed. The protective sleeve 170 could be inserted and latched into the docking station housing 10 with the running tool 50 or on a tool joint, such as tool joint 80A, as discussed above for FIG. 6A. It is further contemplated that when the stripper rubber of the RCD is positioned on a drill pipe or string resting on the top of pipe joint 80A, the drill pipe or string with the RCD could be made up with the drill stem extending above the drilling deck and floor so that the drill stem does not need to be tripped when using the RCD. The drill string could then be inserted through the well center C for conventional drilling.

Notwithstanding the check valves and protective sleeve 170 described above, it is contemplated that whenever converting between conventional and managed pressure or underbalanced drilling, the lubrication and cooling liquids and/or gases could first be run through the lubrication channels 58 and cooling channels 68, 69 with the RCD 14 removed (and the protective sleeve 170 removed) to flush out any drilling fluid or other debris that might have infiltrated the lubrication 58 or cooling channels 68, 69 of the docking control station housing 10.

The foregoing disclosure and description of the invention are illustrative and explanatory thereof, and various changes in the details of the illustrated apparatus and system, and the construction and the method of operation may be made without departing from the spirit of the invention.

We claim:

1. A method for conversion between hydrostatic pressure drilling and controlled pressure drilling, comprising the steps of positioning a housing above a borehole;

removably latching an oilfield device with said housing from a remote location for controlled drilling;

remotely unlatching said oilfield device from said housing;

removing said oilfield device from said housing; and removably latching a protective sleeve with said housing from a remote location for hydrostatic pressure drilling.

2. The method of claim 1 further comprising the step of:

slidably positioning a containment member with said housing.

3. The method of claim 1 further comprising the step of:

communicating a fluid between a channel in said housing and a channel in said oilfield device after the step of removably latching said oilfield device.

4. The method of claim 1 wherein the controlled pressure drilling is performed without a slip joint below said housing.

5. The method of claim 1 further comprising the steps of:

moving said oilfield device to said housing with a running tool; and releasing said running tool from said oilfield device.

6. The method of claim 1 further comprising the step of:

sensing said oilfield device with a sensor to provide interactive operation of said oilfield device.

7. The method of claim 1, further comprising the steps of:

mounting said housing above a marine riser;

providing a port below said oilfield device; and positioning a pressure control device in fluid communication with said port.

8. The method of claim 7, further comprising the steps of:

attaching a blowout preventer with said marine riser below said housing; and positioning said port above said blowout preventer.

9. The method of claim 7, wherein said pressure control device is a valve.

10. The method of claim 9, further comprising the steps of:

opening said valve for controlled pressure drilling; and closing said valve for hydrostatic pressure drilling.

11. The method of claim 7, wherein said pressure control device is a rupture disc configured to rupture at a predetermined pressure.

12. The method of claim 1, wherein said housing comprises a retainer member, and wherein said retainer member is operable to latch said oilfield device and said protective sleeve.

13. The method of claim 12, further comprising the steps of:

communicating a fluid between a channel in said housing and a channel in said oilfield device; and regulating said fluid in response to a value of said fluid remotely received from a sensor disposed with said housing.

14. The method of claim 12, wherein said oilfield device is a rotating control device having a rotatable stripper rubber seal attached with a bearing assembly, and further comprising the steps of:

detecting a rotational speed of said stripper rubber seal with a sensor disposed with said housing; and providing a fluid to said rotating control device through said housing in response to said detected rotational speed.

15. The method of claim 1, further comprising the steps of:

removably latching a latching assembly having a first retainer member and a second retainer member with said housing from a remote location;

removably latching said oilfield device with said latching assembly during the step of latching said oilfield device with said housing; and communicating a fluid through a channel in said latching assembly and a channel in said oilfield device.

16. A method for conversion between hydrostatic pressure drilling and controlled pressure drilling, comprising the steps of:

positioning a housing above a marine riser;

remotely latching an oilfield device with said housing for controlled pressure drilling;

providing a first port below said oilfield device;

positioning a first pressure control device in fluid communication with said first port;

remotely unlatching said oilfield device from said housing;

removing said oilfield device from said housing; and remotely latching a protective sleeve with said housing for hydrostatic pressure drilling.

17. The method of claim 16, further comprising the step of:

positioning a second pressure control device in fluid communication with said first port.

18. The method of claim 16, further comprising the steps of:

providing a second port below said oilfield device; and positioning a second pressure control device in fluid communication with said second port.

19. The method of claim 16, wherein said first pressure control device is a valve.

20. The method of claim 19, further comprising the steps of:

opening said valve for controlled pressure drilling; and closing said valve for hydrostatic pressure drilling.

21. The method of claim 19, wherein said valve is remotely operated.

22. The method of claim 19, wherein said valve is manually operated.

23. The method of claim 19, wherein said valve is a relief valve set to open at a predetermined pressure.

24. The method of claim 19, wherein said valve is a choke valve.

25. The method of claim 16, wherein said first pressure control device is a rupture disc.

26. The method of claim 25, further comprising the step of:

rupturing said rupture disc at a predetermined pressure.

27. The method of claim 16, further comprising the steps of:

attaching a blowout preventer with said marine riser below said housing; and positioning said first port above said blowout preventer.

28. The method of claim 27, wherein said first pressure control device is a valve, and further comprising the steps of:

moving a seal of said blowout preventer to prevent a flow of fluid through said blowout preventer; and opening said valve at a predetermined pressure.

29. The method of claim 27, wherein said pressure control device is a rupture disc, and further comprising the steps of:

moving a seal of said blowout preventer to prevent a flow of fluid through said blowout preventer; and rupturing said rupture disc at a predetermined pressure.

30. The method of claim 16, further comprising the step of:

positioning a containment member above said housing configured to transport a drilling fluid during hydrostatic pressure drilling.

31. The method of claim 30, wherein said containment member is fixedly attached with said housing.

32. The method of claim 31, wherein said containment member comprises an outlet port, and an outer barrel and an inner barrel that move relative to each other.

33. The method of claim 30, wherein said containment member is slidable with said housing.

34. A method for conversion between hydrostatic pressure drilling and controlled pressure drilling, comprising the steps of:

positioning a housing having a retainer member above a borehole;

remotely retaining an oilfield device with said housing retainer member;

remotely releasing said oilfield device with said housing retainer member;

removing said oilfield device from said housing; and remotely retaining a protective sleeve with said housing retainer member after the step of removing said oilfield device.

35. The method of claim 34, further comprising the step of:

sealing between said protective sleeve and said housing.

36. The method of claim 34, further comprising the step of:

sensing said protective sleeve with a sensor disposed with said housing.

37. The method of claim 34, further comprising the steps of:

communicating a fluid between a channel in said housing and a channel in said oilfield device;

sensing data with a sensor disposed with said housing; and regulating said fluid in response to said data.

38. A method for conversion between hydrostatic pressure drilling and controlled pressure drilling, comprising the steps of:

mounting a housing above a blowout preventer on a marine riser;

remotely latching an oilfield device with said housing;

providing a first port below said oilfield device and above said blowout preventer;

positioning a first pressure control device in fluid communication with said first port;

remotely unlatching said oilfield device from said housing;

removing said oilfield device from said housing; and remotely latching a protective sleeve with said housing.

39. The method of claim 38, further comprising the step of:

slidably attaching a containment member comprising an outlet port with said housing, wherein said containment member is configured to transport a drilling fluid.

40. The method of claim 38, further comprising the steps of:

providing a second port below said oilfield device and above said blowout preventer; and positioning a second pressure control device in fluid communication with said second port.

41. The method of claim 40, wherein said first pressure control device is a valve, and said second pressure control device is a rupture disc.

* * * * *